US012152847B2

(12) United States Patent
Penland

(10) Patent No.: US 12,152,847 B2
(45) Date of Patent: Nov. 26, 2024

(54) FIREARM FRAME WITH TRIGGER LOCK DEVICE, SYSTEM, OR METHOD

(71) Applicant: Rustin B. Penland, Nederland, TX (US)

(72) Inventor: Rustin B. Penland, Nederland, TX (US)

( * ) Notice: Subject to any disclaimer, the term of this patent is extended or adjusted under 35 U.S.C. 154(b) by 0 days.

(21) Appl. No.: 17/478,749

(22) Filed: Sep. 17, 2021

(65) Prior Publication Data

US 2022/0178640 A1 Jun. 9, 2022

Related U.S. Application Data

(60) Provisional application No. 63/080,539, filed on Sep. 18, 2020.

(51) Int. Cl.
*F41A 17/54* (2006.01)
*F41A 17/02* (2006.01)
*F41A 17/06* (2006.01)

(52) U.S. Cl.
CPC ..... *F41A 17/54* (2013.01); *F41A 17/02* (2013.01); *F41A 17/06* (2013.01)

(58) Field of Classification Search
CPC ..... F41A 17/46; F41A 17/54; F41A 17/06; F41A 17/063; F41A 17/066
See application file for complete search history.

(56) References Cited

U.S. PATENT DOCUMENTS 2,874,503 A * 2/1959 Niesp ..... F41A 17/22 42/99
2,979,845 A * 4/1961 Christiansen, Jr. ..... F41A 17/06 42/106
3,978,604 A * 9/1976 Smith ..... F41A 17/063 42/70.07
4,970,819 A * 11/1990 Mayhak ..... F41A 17/46 D22/104
5,062,232 A * 11/1991 Eppler ..... F41A 17/063 42/70.11
5,461,812 A * 10/1995 Bennett ..... F41A 17/063 42/70.11
5,546,690 A * 8/1996 Ciluffo ..... F41A 17/066 42/70.11
6,293,039 B1 * 9/2001 Fuchs ..... F41A 17/04 42/70.07

(Continued)

FOREIGN PATENT DOCUMENTS

RU 2753775 C1 * 8/2021 ..... F41A 17/06
WO 2020/112220 A1 6/2020
WO 2022/061178 A1 3/2022

OTHER PUBLICATIONS

International Search Report and Written Opinion for International Patent Application No. PCT/US2021/50976, mailed Feb. 15, 2022, 17 pages.

*Primary Examiner* — Gabriel J. Klein
(74) *Attorney, Agent, or Firm* — Fox Rothschild LLP

(57) ABSTRACT

A firearm frame includes a blocking member disposed adjacent to the trigger guard and configured to block the trigger from firing, an electromechanical actuator configured to actuate the blocking member, a power source configured to power the actuator, and electronics configured to receive remote signals and control the actuator. A system for providing firearm security to a premise includes the firearm frame.

11 Claims, 24 Drawing Sheets

(56) References Cited

U.S. PATENT DOCUMENTS

| | | | | |
|---|---|---|---|---|
| 6,442,880 | B1 * | 9/2002 | Allan | F41A 17/066 42/70.11 |
| 6,629,379 | B1 * | 10/2003 | Doiron | F41A 17/02 42/70.11 |
| 7,339,456 | B1 * | 3/2008 | Buckley | F41A 17/063 42/70.11 |
| 9,354,010 | B1 * | 5/2016 | McCulloch | F41A 17/06 |
| 9,651,325 | B1 | 5/2017 | Gant et al. | |
| 9,733,033 | B1 | 8/2017 | Barido et al. | |
| 2002/0157296 | A1 | 10/2002 | Vivian et al. | |
| 2007/0115955 | A1 * | 5/2007 | Byer | G01C 21/20 370/360 |
| 2016/0084599 | A1 * | 3/2016 | Alicea, Jr. | F41A 17/46 42/70.06 |
| 2017/0163942 | A1 * | 6/2017 | Teetzel | F41A 17/063 |
| 2017/0299301 | A1 * | 10/2017 | Gant | F41C 23/16 |
| 2017/0328661 | A1 | 11/2017 | Milde, Jr. | |
| 2018/0045479 | A1 | 2/2018 | Milde, Jr. | |
| 2019/0154380 | A1 | 5/2019 | Nakamura | |
| 2022/0178639 | A1 * | 6/2022 | Song | F41A 17/54 |

* cited by examiner

FIREARM FRAME WITH TRIGGER LOCK DEVICE, SYSTEM, OR METHOD

CROSS-REFERENCE TO RELATED APPLICATIONS

This application claims the benefit of priority to U.S. Provisional Patent Application No. 63/080,539 filed Sep. 18, 2020, the entire content of which is expressly incorporated herein by reference thereto.

BACKGROUND

Embodiments of the present invention relate to firearms and systems and methods for locking a firearm. Embodiments of the present invention further relate to security systems that include systems and methods for selectively locking and unlocking a firearm.

Various weapons and firearms have been developed over the years to provide protection to persons and facilities against potential threats during sudden exigencies or emergencies. In some circumstances, firearms may be locked or otherwise secured until a threat develops that requires access thereto. While various systems such as cabinets or locks exist for controlling access to a firearm, there is a need for a firearm locking system that enables selectively and remotely locking and unlocking the firearm.

There is a further need for a security system that balances the functions of securing access to a firearm until needed, and selectively providing access to or unlocking the firearm when needed, and selectively disabling or locking the firearm based on monitored circumstances surrounding the firearm. The present invention now provides a number of improvements over firearm locking and associated security systems that are significantly advanced over what is known in the art.

SUMMARY OF THE INVENTION

According to embodiments of the present invention, a firearm frame is disclosed. The firearm frame includes a blocking member disposed adjacent to a trigger guard and configured to be moved into a position that physically blocks the trigger from firing such as the blocking member being adapted to extend or rotate to block the trigger (e.g., block the path of a trigger member that is integrated as part of the trigger) from firing, an electromechanical actuator configured to actuate the blocking member, a power source configured to power the actuator, and electronics configured to receive remote signals and control the actuator. The trigger can be understood to refer to or include the assembly with the trigger member. Other blocking member or mechanisms are contemplated.

In some embodiments, the firearm frame further includes an electronic trigger lock housing integrally formed with the frame and one or more of the blocking member, the electromechanical actuator, the power source, and the electronics are mounted into the housing.

In some of these embodiments, a wall of the housing includes a portion of the trigger guard and further includes an aperture through which the blocking member extends from the housing into the trigger guard when actuated by the actuator.

In some embodiments, the electromechanical actuator is a solenoid configured to extend the blocking member into the trigger guard when energized and retract the plunger from the trigger guard when de-energized.

In certain embodiments, when the blocking member is extended into the trigger guard, the blocking member blocks the rotation of the trigger to disable the trigger.

In some of these embodiments, the trigger includes a trigger member that pivots downward about an axis when the trigger is pressed, and the extended blocking member is configured to block the trigger member from pivoting.

In some embodiments, the blocking member is a plunger or a pin.

In certain embodiments, the electronics include a wireless receiver configured to receive commands to lock or unlock the trigger.

In some embodiments, the electromechanical actuator is mounted on a portion of the housing that is integrally formed with the firearm frame to strengthen the electromechanical actuator and the blocking member against pressure from the trigger.

In certain embodiments, the power source is a rechargeable battery and the firearm frame further includes contacts disposed on an outer surface of the frame, each contact being electrically connected to a terminal of the battery and the contacts being configured to receive power from an external battery charger to charge the battery.

According to embodiments of the present invention a system for providing firearm security to a premises is also disclosed. The system includes a lockable firearm cabinet located on the premises, the cabinet having a locking mechanism and configured to receive a firearm; a firearm configured to lock into the cabinet and having an electronic trigger lock configured to receive remote signals to enable and disable the firearm; monitoring equipment configured to detect and transmit an indication of the status of the premises; and a remote monitoring station configured to receive the indication of the status of the premises, wherein the remote monitoring station is further configured to transmit the remote signals to enable and disable the firearm.

In some embodiments, the electronic trigger lock includes a battery and the lockable fire cabinet includes a battery charger configured to charge the battery through contacts disposed on an outer surface of the electronic trigger lock.

In certain embodiments, the monitoring equipment includes a video camera configured to record the premises and the monitoring station includes monitors configured to display the recording of the premises.

In some embodiments, the remote signals are transmitted and received over a wireless network.

In certain embodiments, the monitoring equipment includes a sensor to detect an entry into or an exit from the premises.

In some embodiments, the firearm has a unique address and the monitoring station is configured transmit selectively transmit the remote signals to the firearm using the unique address.

In certain embodiments, the electronic trigger lock includes a housing, a plunger in the housing configured to extend out of the housing to block operation of the trigger, an actuator in the housing configured to actuate the plunger, a power source in the housing configured to power the actuator, and electronics in the housing configured to receive the remote signals and control the actuator.

According to some embodiments of the present invention, a device for locking the trigger of a firearm is disclosed. The device includes a housing configured to mount to a firearm, a plunger in the housing configured to extend out of the housing to block operation of the trigger, an actuator in the housing configured to actuate the plunger, a power source in the housing configured to power the actuator, and electronics in the housing configured to receive remote signals and control the actuator.

In some embodiments, the actuator is mounted on a portion of the housing that is integrally formed with the firearm frame to strengthen the actuator and plunger against pressure from the trigger.

BRIEF DESCRIPTION OF THE DRAWINGS

Preferred features of the invention are more fully appreciated upon a review of the appended drawing figures, wherein.

DETAILED DESCRIPTION OF THE INVENTION

Embodiments of the present invention provides for a device, system, or method that provides additional levels of protection when a firearm must be disabled due to unauthorized access or when circumstances requiring access to the firearm have ended. This is preferably in addition to (e.g., distinct and separate from) any safety button or switch that is included in conventional firearms (is standard feature of firearms). Specifically, embodiments of the present invention incorporate a gun frame or lower that is produced as a single piece using steel or other material to include a receiving frame for an electronic trigger lock. The electronic trigger lock may be integrally formed with the gun frame and include electronics and/or mechanical elements that can be used to remotely lock the firearm when a signal is received at the firearm. The firearm frame or lower may thus include a circuit board, a battery, and mechanical arm (that can extend out) that are configured to disable the physical trigger of the firearm. The gun frame can be configured to carry, house, enclose, or contain the electronics and/or mechanical elements and therefore, the frame can comprise one or more such features. The gun frame having an electronic trigger lock according to embodiments of the present invention may be implemented in applications such as system and/or methods for providing firearm security to facilities such as schools or campuses, that may enable monitoring and selective enabling and disabling of the firearms based on local circumstances. Such systems and methods may involve providing firearm storage cabinets through a facility. The specification will first generally describe examples of such applications.

In some embodiments, the invention may also have a number of security systems that can be built into the cabinet of the invention or that can be used for separately accessing the internal compartment of a firearm storage cabinet. One use of the cabinet is as a weapon locker in a schoolroom with the teacher being the authorized user. Details of such a system can be found in U.S. Pat. No. 10,282,949, the entire content of which is expressly incorporated herein by reference thereto.

Figure 1A:
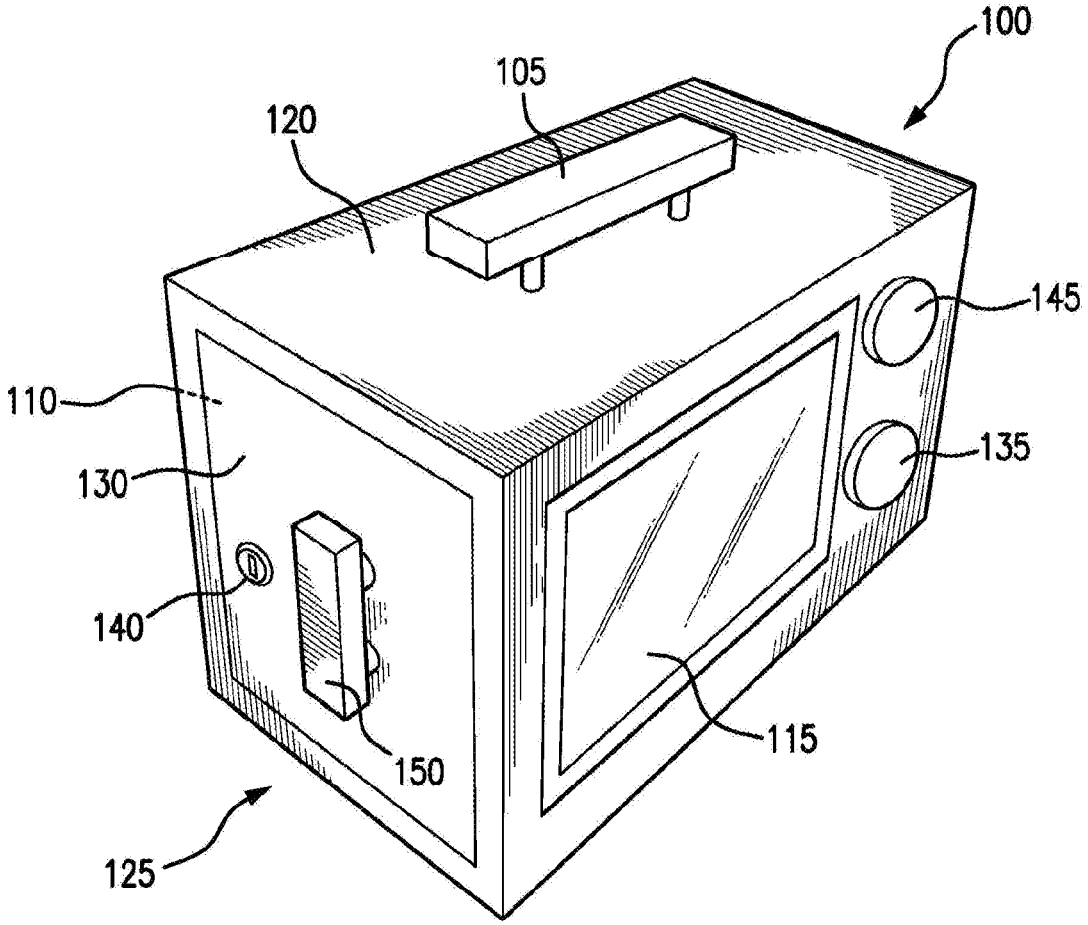
FIGS. 1A to 1C illustrate a firearm cabinet and receptacle according to the present invention.
Figure 1B:
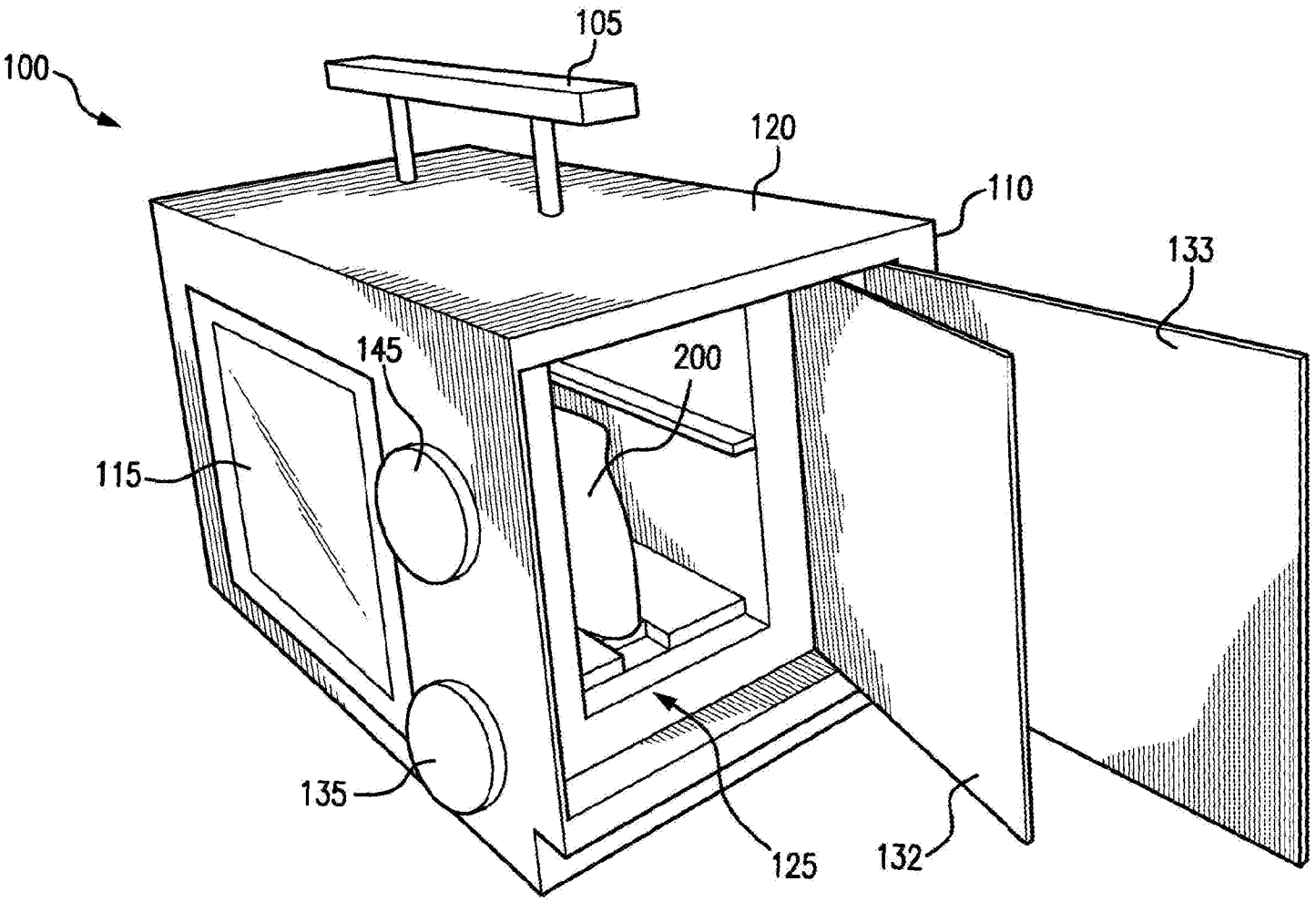
Figure 1C:
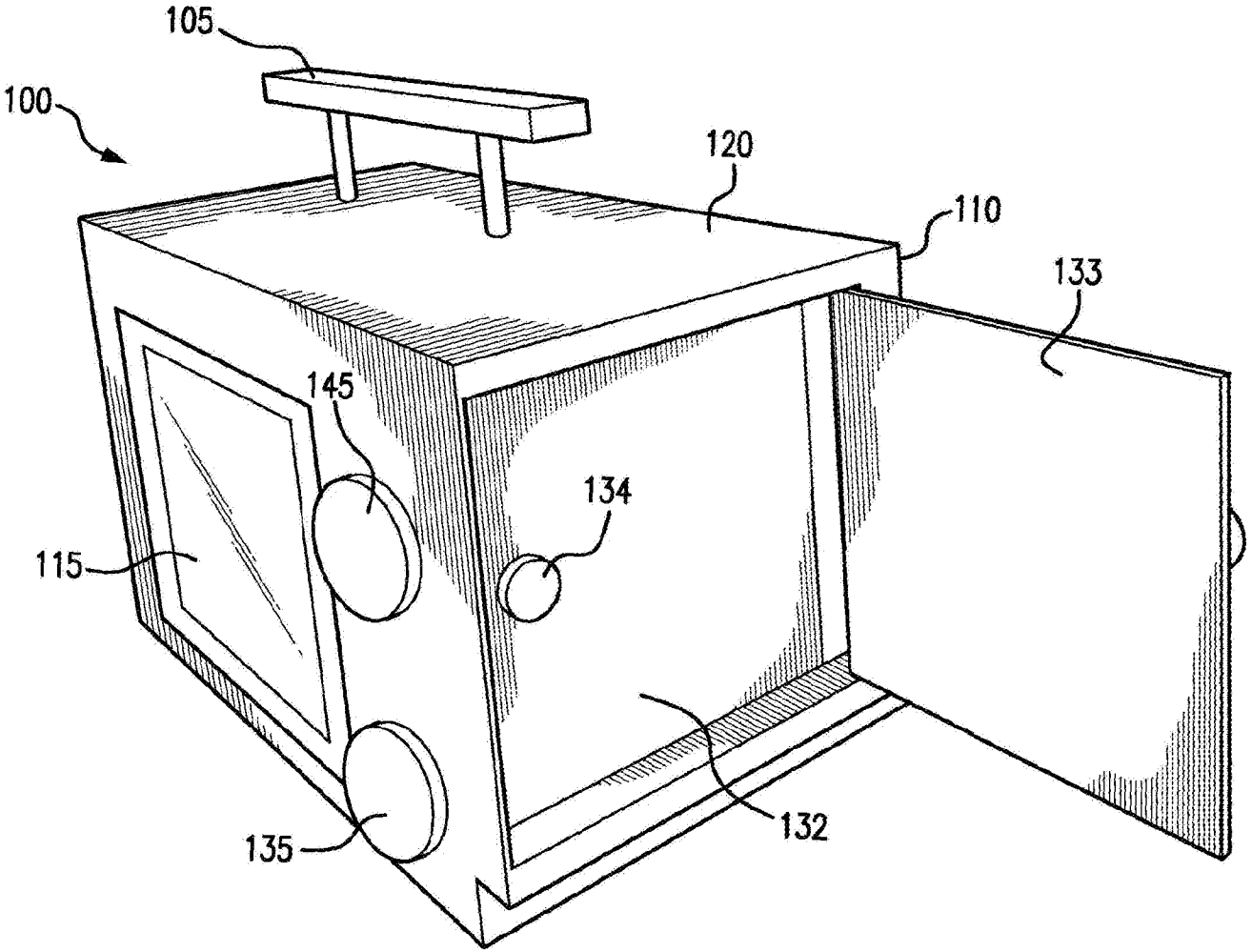

FIGS. 1A to 1C illustrate a lockable firearm cabinet 100 according to the present invention. This cabinet 100 includes a housing having side 110, top 120, back and bottom walls which form an enclosure having a front opening. The front opening receives a receptacle 125, only the front plate 130 of which is shown in FIG. 1A. The receptacle 125 includes a carrying or grasping handle 150 and an appropriate key lock 140 for securing the receptacle to the enclosure. This lock 140 when engaged by the key, secures the front plate 130 of the receptacle to the sidewall 110 of the housing so that the receptacle cannot be removed from the housing except by an authorized user who has the key. And while a conventional key lock is shown, it is also considered to be within the scope of the invention to include other, alternative locking mechanisms, such as a keypad or biometrics for unlocking the receptacle 125. As noted elsewhere herein, such mechanisms may include fingerprint detectors, retina scanners or face recognition cameras and software to provide the quickest access to remove the receptacle or to access its contents.

While FIG. 1A illustrates the housing in the form of a box or enclosure, it is envisioned that the box will be securely mounted upon a wall, cabinet, desk, floor or other structure so that it is not possible for someone to try to carry off the enclosure with the secured weapon inside. Also, the enclosure is mounted in a manner so that both the front and rear sides are accessible. FIG. 1A further illustrates that in certain embodiments, cabinet 100 may include a carrying handle 105 disposed at top 120, a touch screen 115 disposed on a side wall opposite side 110, and a first button/indicator 135 and a second button/indicator 145 both disposed adjacent to touch screen 115. Further, in some embodiments, touch screen 115 may include the above-discussed keypad or biometrics for unlocking the receptacle 125. In certain embodiments, first button 135 and second button 145 may be configured to indicate a status of the receptacle 125 as locked (red light) or unlocked (green light), or the like.

FIGS. 1B and 1C illustrate the firearm cabinet 100 and receptacle 125 in an opened state (FIG. 1B) and a closed state (FIG. 1C). In certain embodiments, cabinet 100 may include a first access door 133 configured for pivotal movement about an axis from a closed position to an opened position (shown). Further, in some embodiments, receptacle 100 may also include a second access door 132 disposed proximal access door 133, where access door 132 is configured for pivotal movement about an axis from a closed position (FIG. 1C) to an opened position (FIG. 1B). In certain embodiments, access door 132 may include a knob 134 to open door 132 for easy access. Further, in some embodiments access door 133 may also include a knob to open door 133 for easy access. In certain embodiment, having two access doors (132, 133) may provide additional security when accessing a stored weapon 200. In some embodiments, these access doors may be configured to be lockable or to trigger an alarm to sound and to display on touch screen 115.

Figure 2:
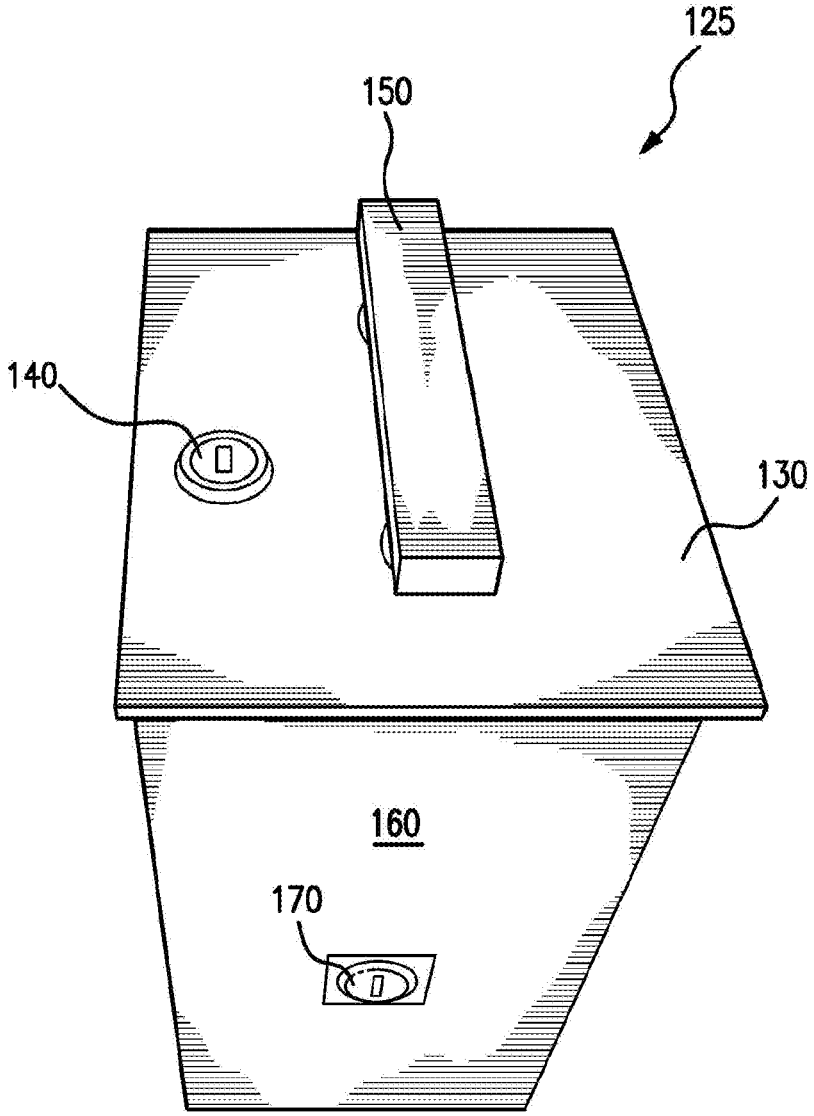
FIG. 2 is a bottom front perspective view of the receptacle that is removed from the cabinet for transport of the weapon secured therein.
Figure 3:
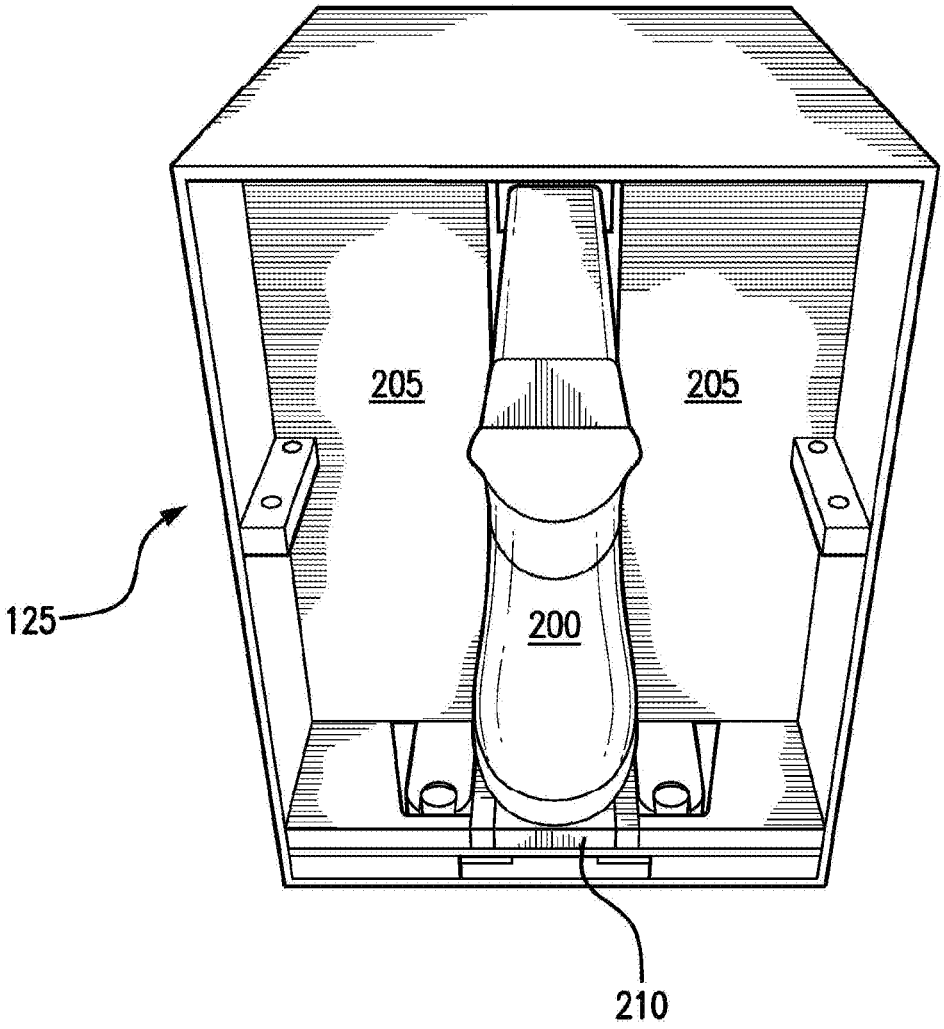
FIG. 3 is a rear view of the receptacle of FIG. 2.

FIGS. 2 and 3 illustrate the receptacle 125 of the invention after it has been removed from the housing or cabinet 100. In FIG. 2, the front face 130, handle 150, and key lock 140 are readily visible, along with a bottom or lower member that forms the floor or base 160 of the receptacle 125. Also illustrated in base 160 is a further lock 170 the purpose for which will be discussed hereinafter.

FIG. 3 illustrates the back side of the receptacle 125 with the rear plate removed so that the securement of a weapon 200 into the receptacle 125 can be more easily viewed.

Figure 4:
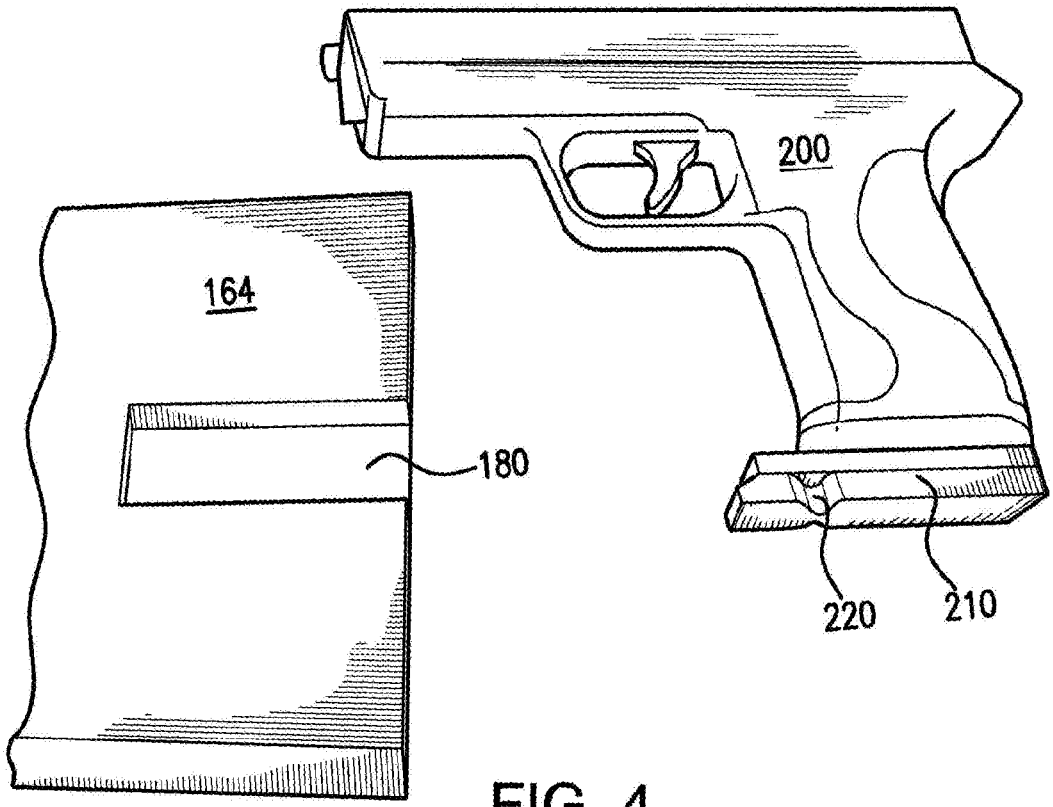
FIG. 4 is a view of a weapon with cartridge attachment and partial view of the floor of the receptacle of FIG. 2.

FIG. 4 illustrates weapon 200 in the form of a handgun to which is attached a mounting structure to 210 representing the cartridge for the weapon, or an attachable member that is provided on the weapon 200 or weapon cartridge to allow it to be received in the receptacle 125. To initially place the firearm in the cabinet, the weapon cartridge is either a separate component that is attached to the weapon or it is the cartridge itself which is capable of engaging a slot in the base of the cabinet. The weapon and cartridge or attachment is slid into the slot and into place so that it initially locks into the receptacle. This allows an authorized user to transport the weapon securely inside the cabinet with the weapon secured there in so that it cannot be accessed by others. In addition to the weapon being mounted in the cabinet, the kind that internal structure can be designed with appropriate baffles or walls that would prevent someone from reaching in and grabbing or operating the trigger of the weapon.

The upper portion of the receptacle floor is shown at 164: it includes a slot 180 which is configured to have the same width as mounting structure 210. Mounting structure 210 also includes side notches 220 which assist in securing the structure 210 and weapon 200 to the base of receptacle 125 as further illustrated in FIGS. 5 to 8A.

Figure 6:
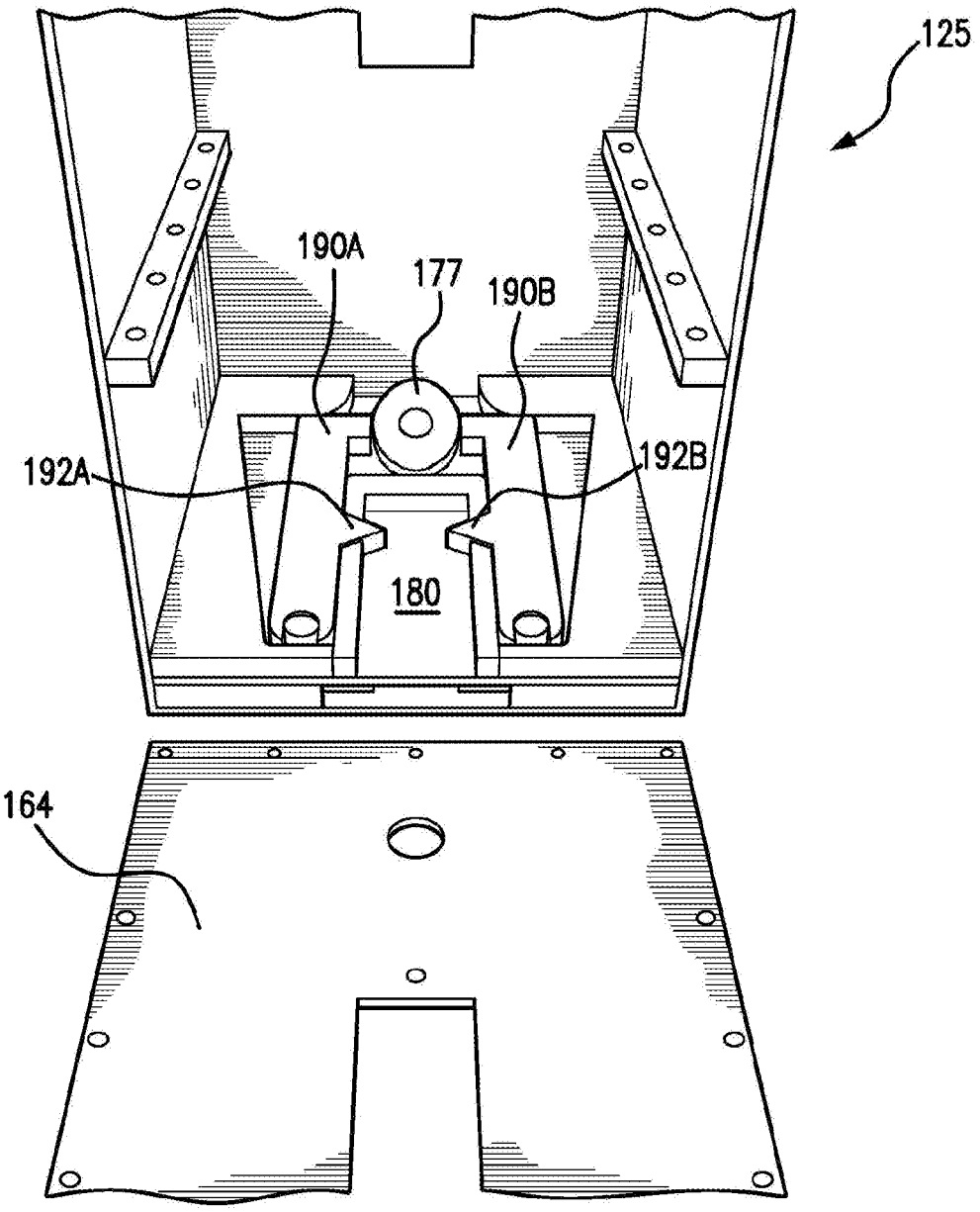
FIG. 6 is a rear view of the receptacle of FIG. 2 with the floor removed to show the locking mechanism.

The locking mechanism is best shown in FIGS. 6 to 8A. In FIG. 6, upper portion of the receptacle floor 164 is removed to further illustrate the components of the locking mechanism. FIG. 6 also illustrates the tab members 192A, 192B which engage the side notches of the mounting structure 210 to lock it in place in the receptacle. Also receptacle upper portion 164 has a narrower opening than slot 180 so that the mounting structure 210 is securely retained in slot 180 after being slid into the slot to snap lock in place.

Figure 5:
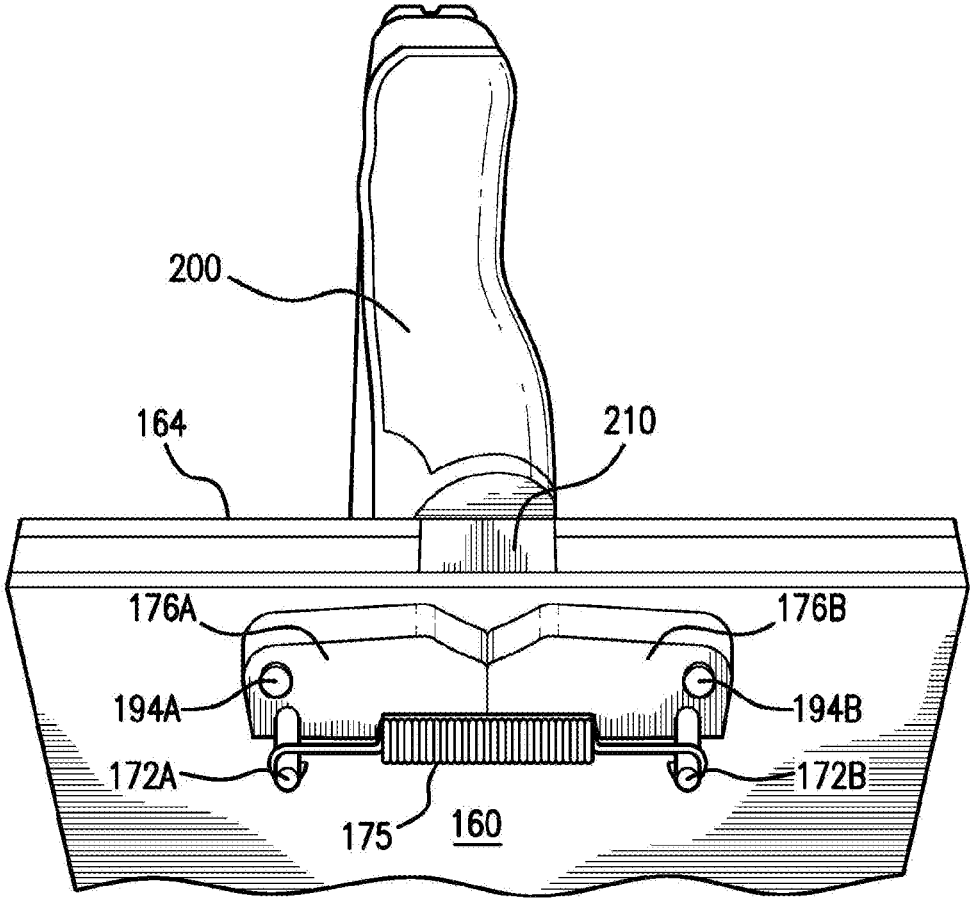
FIG. 5 is a rear bottom perspective view of the floor of the receptacle of FIG. 2 with the walls removed and showing the weapon secured thereto.

The locking mechanism includes a pair of arm members 190A, 190B secured to pivot pins 194A, 194B. These arm members can move towards slot 180 and away from it due to rotation of the pivot points, but they are biased by spring 175 toward slot 180. This is best shown in FIG. 5 where spring 175 is attached to pins 172A, 172B which are secured to arm members 190A, 190B through floor 160.

Figure 7:
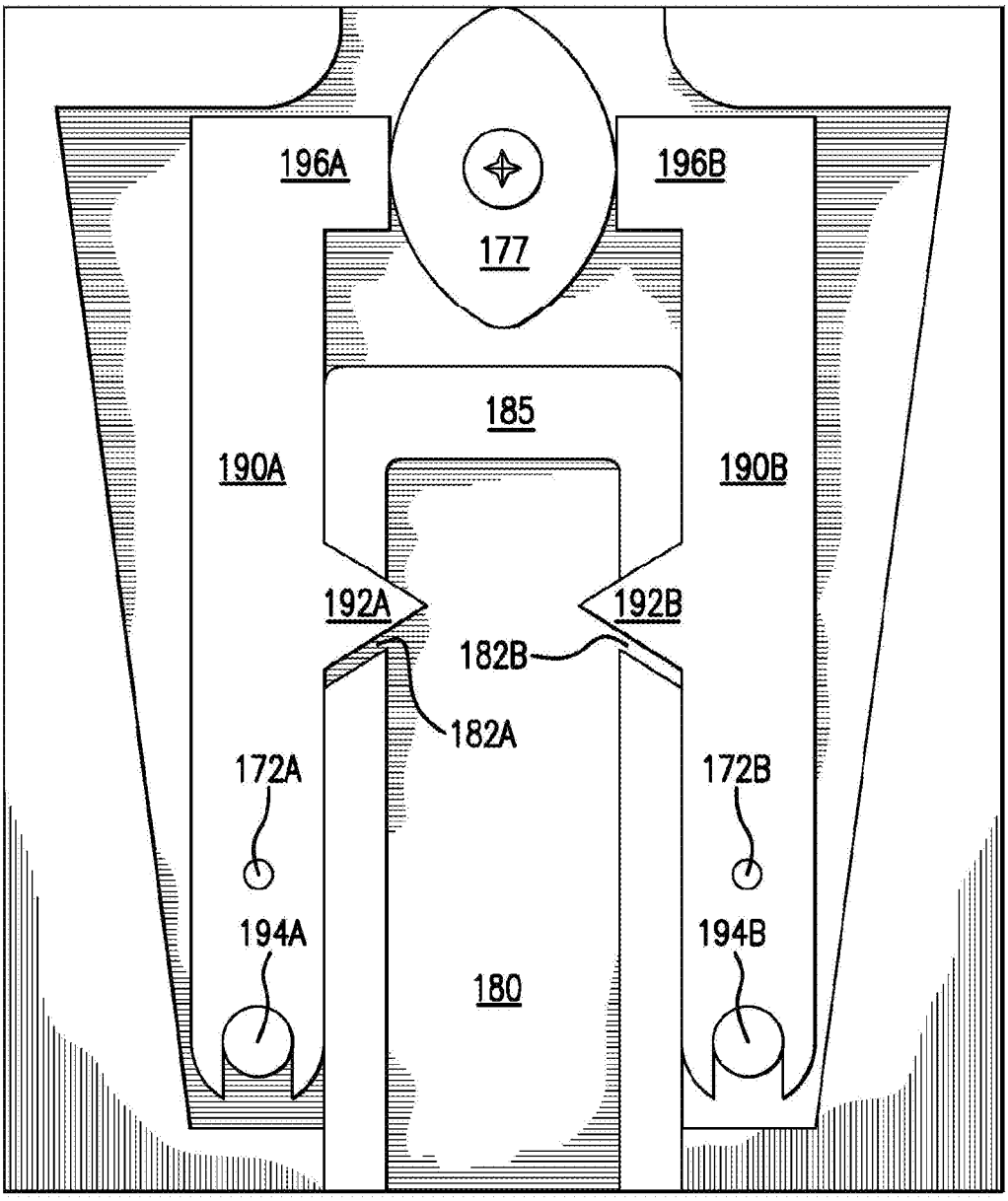
FIGS. 7 and 8A are views of the locking mechanism in the locked and unlocked positions respectively.
Figure 8A:
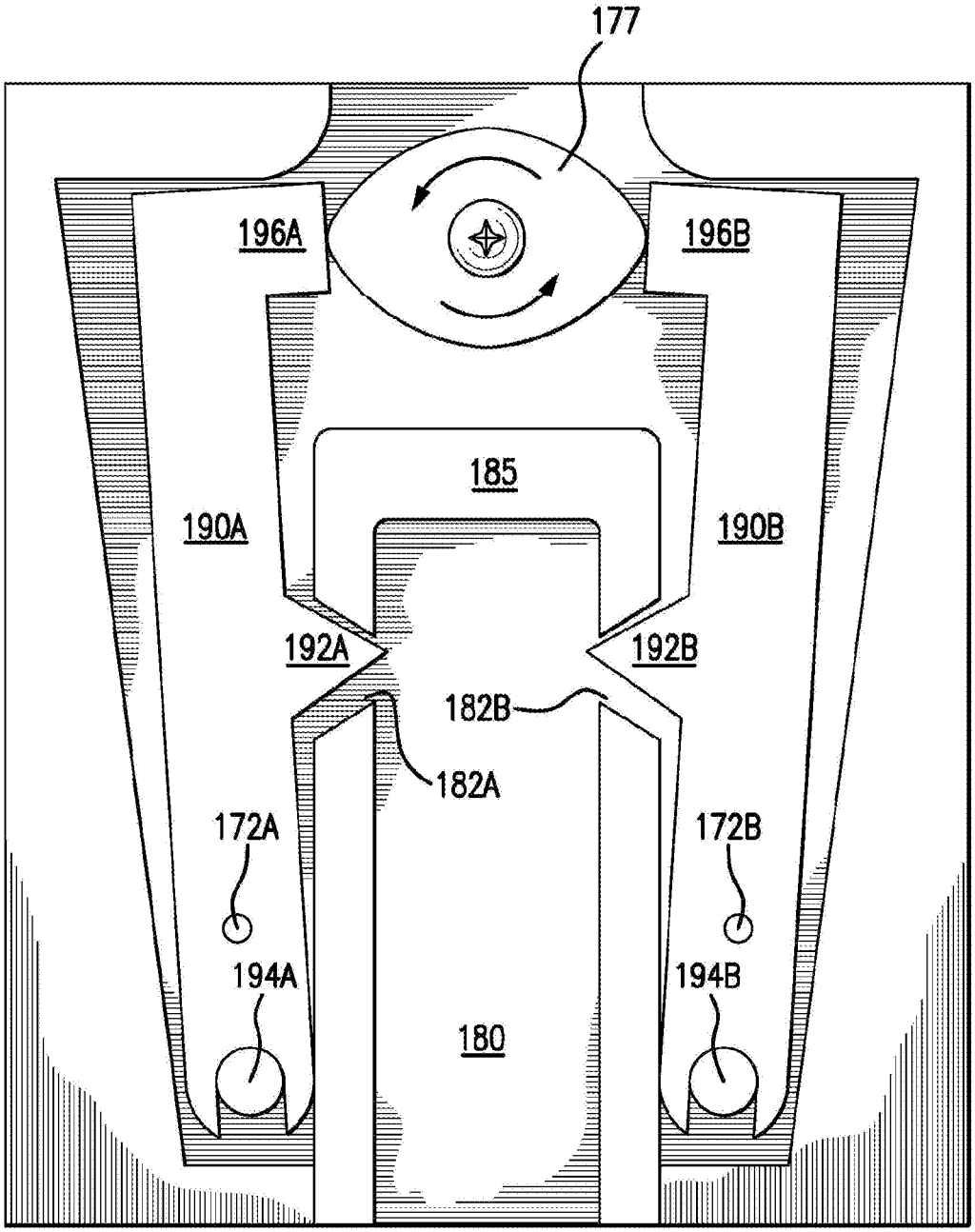

In FIG. 7, the locking mechanism is illustrated in a closed or locked position wherein the tab members protrude into slot 180 through apertures 182A, 182B in slot support structure 185, while in FIG. 8A, the locking mechanism is illustrated in an open or unlocked a position wherein the tab members are withdrawn into apertures 182A, 182B in slot support structure 185.

The locking mechanism can be moved between the locked and unlocked positions through the use of key lock 170 (FIG. 2) and disc member 177 (FIGS. 7 and 8A). Disc member 177 acts as a cam and has a wider dimension and narrower dimension about its perimeter. When this member 177 is rotated by key lock 170 to the position shown in FIG. 8A, where the larger dimensions of the disc contact ends 196A, 196B of the arm members, the spring biasing force is overcome and the tab members 192A, 192B are withdrawn into apertures 182A, 182B to unlock structure 210 from the slot.

It is also possible to lock the structure 210 in the slot by rotating disk 177 so that the thinner areas contact arm member ends 196A, 196B to urge tab members 192A, 192B to into apertures 182A, 182B to engage the notches 220 of structure 210 to lock it in the slot. This is illustrated in FIG. 7.

The locking of mounting structure 210 and weapon 200 in slot 180 is the default position when the receptacle 125 is removed from the enclosure. This allows the weapon to be transported in a secure cabinet by authorized personnel such that the weapon cannot be removed from the cams it without the appropriate lock releasing mechanisms. Thus, the weapon and its cartridge can be safely and securely transported from one point to another. It is also possible to include in the receptacle structure at the additional wall members or trigger engaging locks to prevent accidental or unintended discharge of the weapon as it is transported.

As shown in FIG. 3, the rear part of the receptacle is generally open when it is stored inside the enclosure, but for transport, an additional plate 205 can be temporarily secured or locked onto the open rear of the receptacle to conceal the weapon therein.

Once the weapon cartridge or support is locked in place, it can only be removed from the receptacle by turning the disk so that the larger portions push against the ends of the arms and move them outwardly so that the protrusions are retracted from the apertures. This releases the lock. And as noted sliding the cabinet into a wall mount or other supporting structure allows a tab member to engage a pair of shorter flap members which are linked to the lower parts of the arm member to pivot them out of position so that the protrusions do not engage the apertures and lock the cartridge to the cabinet. This allows the weapon to be available in the cabinet after the cabinet is placed in the wall or support structure.

As described above the weapon would be maintained securely in slot 180 during transport or movement of the receptacle 125. When the receptacle is slid into the housing or enclosure, it is not desirable to maintain the weapon secured to the slot since that would delay access to the weapon when necessary. There is also no need to lock the weapon in the receptacle because the receptacle is locked in the enclosure. As noted herein, the opposite side of the enclosure has one or two access doors to allow an authorized user to quickly access the weapon when needed.

The weapon cartridge would be separate from the receptacle or enclosure but it is primarily intended to hold the weapon safely during transportation and handling of the receptacle. This would be done by providing the receptacle to be transportable. After delivering the weapon to the desired location, the receptacle would be inserted into the enclosure and secured thereto so that the weapon can be released in the cabinet so that it can be accessed through the access doors. If a supervisor had to remove the weapon they would remove it differently from how the user would access it. For example, if a substitute teacher was going to teach a certain class that had a firearm in the box and they didn't want to use a gun but they wanted to use pepper spray, the supervisor could insert a key to turn the lock to release the cartridge with gun and replace it with, e.g., a cartridge that had pepper spray in it. This is so the supervisor is not walking down the hall with a gun in hand after he or she did the exchange. This guarantees keeping the weapon in lock down. The weapon can only be handled outside the cartridge when using a special tool to remove it from the cartridge so if the supervisor didn't have a tool they could only walk with the receptacle in hand without showing the weapon.

An additional feature of the invention allows the weapon 200 and structure 210 to be released from the notch 180 when the receptacle is secured to the enclosure. As best shown in FIG. 5, this release structure includes pivot pins 194A, 194B that are operatively associated with and connected to flap members 176A, 176B. When the receptacle is slid into the enclosure, these flap members are contacted by a fixed rod in the enclosure which causes the flap members to turn the pivot pins 194A, 194B. This in turn overcomes the biasing force of the spring 175 which causes the arm members (see FIG. 8A) to withdraw the tab members from the apertures. Therefore, the weapon is not secured to the receptacle so that it can be quickly retrieved when accessing the receptacle interior from the doors on the back of the enclosure.

Figure 8B:
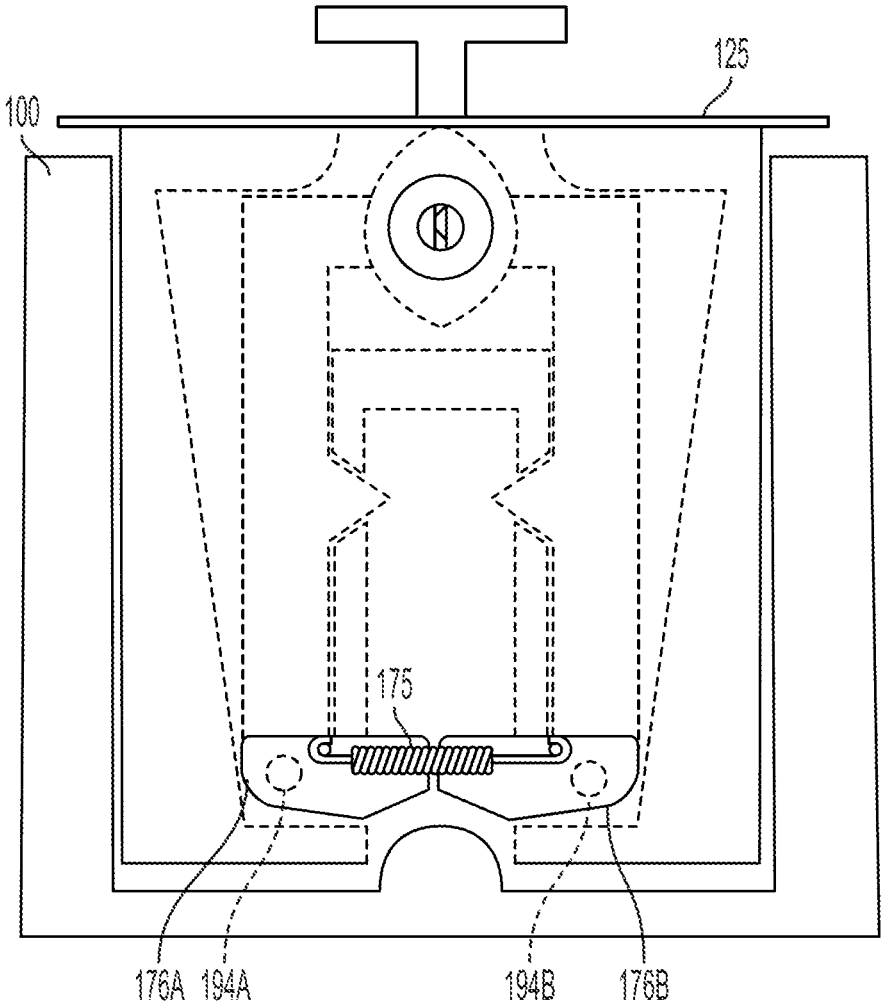
FIGS. 8B and 8C are bottom views of the receptacle showing the locking mechanism in the locked and unlocked positions respectively.
Figure 8C:
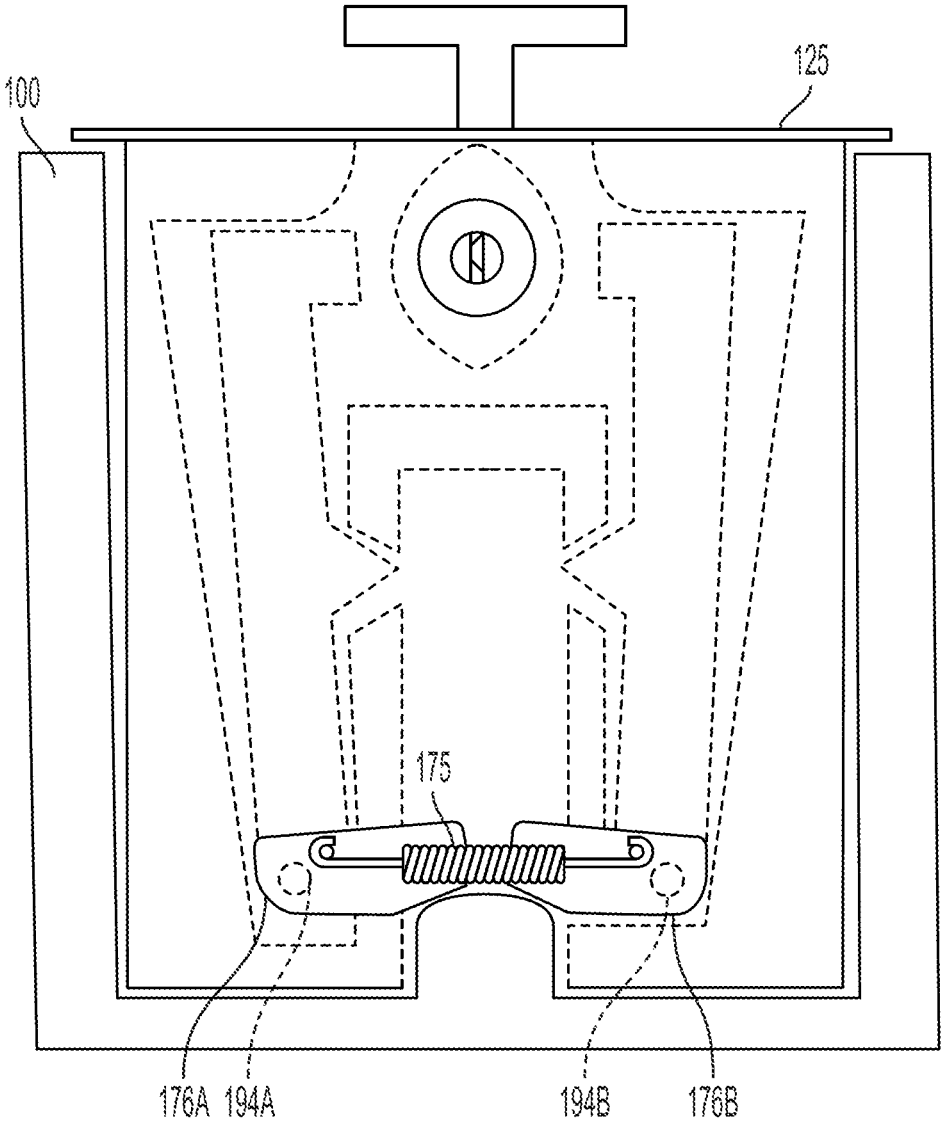

FIGS. 8B and 8C illustrate the release structure on the bottom of the receptacle in the closed and open positions, respectively, after the receptacle 125 has been inserted into the housing 100 has pivot pins 194A, 194B are securely attached to both the flap members 176A, 176B and the arm members 190A, 190B (see FIG. 8A). This can be done by using screws, other fasteners or an adhesive when the parts are made of wood, or by welding or brazing when the parts are made of a metal such as steel or aluminum. In these two figures, the disc member 177 is shown in phantom in the usual position that would allow locking of the tabs 192A, 192B to securely hold the weapon in the receptacle. In FIG. 8B, the tabs are in a locking position, while in FIG. 8C, the flap members have been moved to cause the pivot pins to rotate to move the tab members while also overriding the spring 175 so that the tabs are unlocked to allow the weapon to be removed from the receptacle.

As it is possible for someone to tamper with the flap members to release the weapon when the receptacle is in transit, FIG. 5 illustrates a wall member 179 that is provided to close off the back area of the receptacle. A further panel (not shown) can be provided below the flap members so that when the receptacle is in transit, the flap members are not visible so that they can securely hold the weapon in the receptacle. The further panel can be removable to facilitate returning the receptacle to the enclosure after transport is completed.

When the receptacle is secured to the enclosure, it can be accessed through one or two doors that are provided on the back of the enclosure. As in the copending application, access to the interior can be made through a dual button activation system. To open the first door one button is pushed after access by use of a key, keypad, or biometric pad. At this point there is an additional plate or door which prevents direct access to the weapon until after a further button is activated. And as noted in the prior application, activation of the second button also activates video and audio in the room so that monitoring personnel can determine whether and how the disturbance may be escalating.

The access doors include two buttons 135, 145 so that the first one can send a signal that something out of the ordinary is happening in the room while the second button is activated to access the weapon or firearm in the cabinet and indicate that the situation is becoming an emergency. The invention assumes that an authorized person would be able to initially open the outer door of the cabinet based on a remote keypad or biometric device that is unique to the authorized user, or the code to which is known only to the authorize user. For example, in a school setting, the initial access by the teacher would activate a video camera in the room while also sending a message to a monitoring station or the principal's office so that the disturbance on the room can be monitored. At that point, the principal or monitor can check in with the authorized user to make sure that the situation is coming under control or that further actions are appropriate.

The invention is also operable with a smart weapon or smart weapon cartridge that would communicate with the monitoring station after being withdrawn from the receptacle. As an example, if the authorized user does not respond to the principal, the principal can disable the box or disable the smart gun inside the box so that the teacher cannot use it inappropriately or further such that an intruder or other bad actor either cannot access the weapon or cannot use it even if the weapon is accessed. For this, the receptacle (or other system element) would have electronics that wirelessly communicate with the gun such that the smart gun can be disabled even after it is removed from the receptacle.

The access doors can include two buttons that can be activated to access the weapon or firearm in the cabinet. The invention assumes that an authorized person would be able to initially open the outer door of the cabinet based on a remote keypad or biometric device that is unique to the authorized user, or the code to which is known only to the authorize user. For example, in a school setting, the initial access by the teacher would activate a video camera in the room while also sending a message to a monitoring station or the principal's office so that the disturbance on the room can be monitored. At that point, the principal or monitor can check in with the authorized user to make sure that the situation is coming under control or that further actions are appropriate. For example, if the authorized user does not respond to the principal, the principal can disable the box or disable the smart gun inside the box so that the teacher cannot use it inappropriately or further such that an intruder or other bad actor either cannot access the weapon or cannot use it even if the weapon is accessed. For this, the support plate would have electronics that wirelessly communicate with the gun such that the smart gun can be disabled even after it is removed from the cabinet.

Although shown in FIGS. 1-8 of the drawings as a wood prototype, the cabinet itself would preferably be a metal box with mechanisms to operate it. The design of a box with a certain size, predetermined workflow functionality through mechanisms and aesthetics making it correct in design for the best solution for the desired kind of use. The compartment box has better functionality geared toward accessing compartments in a certain manner with provisions to mount cameras, microphones and electronics to it. If a person was in a situation to access a compartment he/or she could access the compartment in a safe predetermined workflow. This box design would be designed so that electronic sensors can mounted a later time. For this, an electronic module can be provided that would have sensors connect to it. This module would have an embedded chip with software that would allow sensor data to be read by an app running on a phone, tablet or watch via Bluetooth or the internet. This module would have provisions for all different kinds of inputs. The preferred design is for a firearm as a compartment box because accessing the box in a safe manner is primary while the contents of the box are a secondary consideration.

For example, if a rogue supervisor wanted to access a weapon and use it they could not access it unless they had the cartridge installed in the firearm box or had a special tool. This is so that the weapons can be sent to authorized handlers for inspection or routine maintenance and be safe from wrong use during transport. When the authorized handlers receive the cartridges they would use a special access tool to remove the weapon. If a superintendent at a school district deployed this whole system across multiple schools he or she would know that the only time a weapon is exposed outside the cartridge is when a user deployed it through the firearm box or when the cartridges are sent to handlers for maintenance. This cartridge/cabinet combination significantly increases the safety of the stored weapon.

The firearm cabinet is operatively associated with a weapon cartridge. This has a key lock to engage the lock pins to lock the weapon into place. If the weapon does not have a properly configured cartridge, a structure can be attached to the cartridge to perform that function. It is envisioned that weapon cartridges can be designed to be operable with the present cabinet as the size of the slide lock and other components can be tailored to the sizes of the various weapon cartridges.

The firearm cabinet is provided with the weapon as follows:

The weapon is loaded into weapon cartridge so it clicks in place (i.e., it locks in place by a lock mechanism in the cartridge). At this point the weapon cannot be removed out of the cartridge because the locking mechanism is in place. If a person wanted to remove the weapon at this point they would need to use a special tool.

The weapon cartridge is installed in the slide lock in the firearm cabinet. A key is inserted into the key hole of the bottom lock and is turned to actuate the protrusions or locking pins to secure the cartridge in place in the cabinet. The cabinet can now be used to safely transport the weapon.

After the weapon is returned to the room, the cabinet is placed in a wall mounting or other opening for storage of the weapon in the room or location. The weapon lock mechanism in the cartridge is automatically disengaged when the cartridge is locked down in the cabinet as described herein. This allows the weapon to be freely removable from the cabinet and removed at the end that has the access doors after those doors are opened by an authorized user who has possession of the applicable codes.

Alternatively, the weapon lock mechanism can be engaged by inserting the key in the bottom lock to unlock the arm members so that the cartridge is free for removal of the weapon from the cabinet.

Another unique feature of the box is that it can include sensors that would be activated when the box is activated. This technology would report the activity of what occurs at the box through the monitoring of sensors which can be installed at points on the area or object being secured. The sensors would be wired to a small box mounted on the device being monitored. Each sensor would plug into the small box/module and the box would communicate over the web to a cloud. Each box would not have to be linked to a local server. This is in effect a small box/module that has several female plugs that allow to have multiple devices plugged into it to be monitored over the net via an app for an iPhone, watch, tablet or computer. This module would use sim card technology for authentication to cloud and Bluetooth for local communication to local electronic devices such as speakers or other sound generating devices that provide audible alerts, beeps, sirens, or tones.

Another embodiment of the invention relates to a weapon or weapon cartridge that mounts on a wall plate. The weapon or weapon cartridge has electronics in it. The wall plate would house the biometrics or a keypad on front side. The system would have software in a computer that would control functions of the wall plate that holds the cartridge with the gun. The software from the computer would have the ability to send information to the wall plate, on through to the cartridge, and into the cartridge. Alternatively, the gun can be a smart gun that has its own electronics that operate similarly. The wall plate would have the ability to wirelessly talk to the cartridge or smart gun after it was deployed. This feature is important because if a registered user decides to go rogue or if the weapon falls into the wrong hands then the monitor or administrator can have the ability to disarm the user or smart gun.

Figure 9:
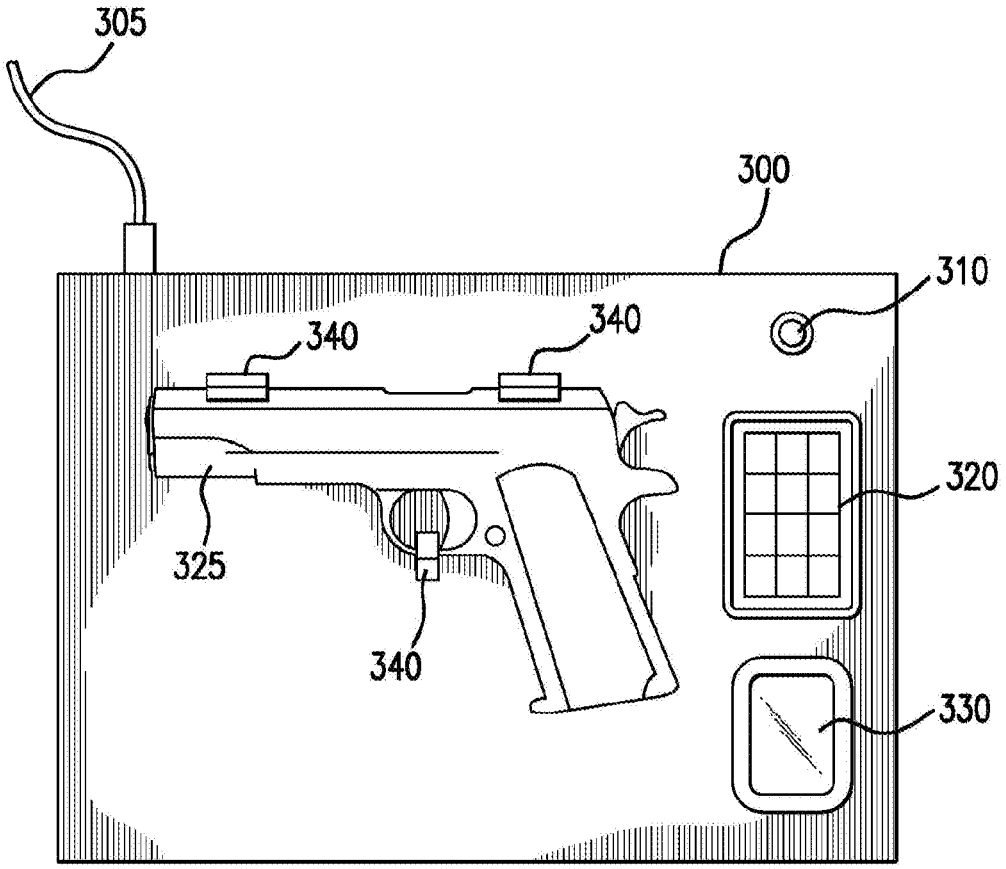
FIG. 9 is a schematic illustration of one wall plate for securely mounting and holding a weapon thereon.

FIGS. 9 to 12 provide variations of mounting of a gun or smart gun 325 to a wall plate. FIG. 9 illustrates a wall plate 300 that includes electronics (a red button 310, keypad 320 and biometrics 330) and that includes a claw or claws 340 to grip the gun 325 and hold it in place on the wall plate 300. In some embodiments, electronics (a red button 310, keypad 320 and biometrics 330) may be electrically connected via a computer link or communications line 305 to a computer of communications system.

Figure 10:
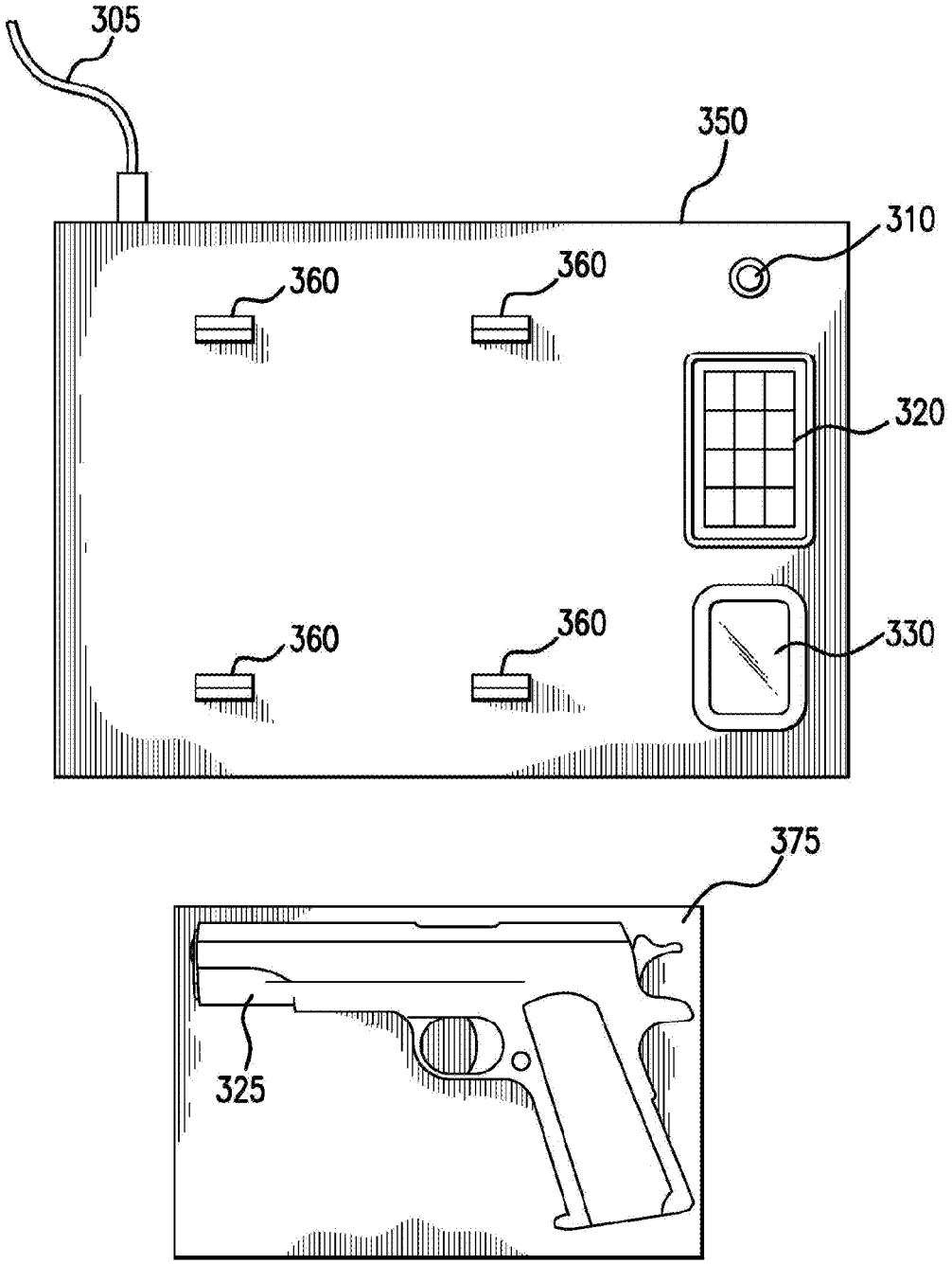
FIG. 10 is a schematic illustration of another wall plate for securely mounting and holding a weapon thereon.

FIG. 10 shows another wall plate 350 that includes a snap locking mechanism 360 that attaches a gun 325 mounted on a gun cartridge or immobilization plate 375 by engaging a corresponding mechanism. Again, the wall plate 350 has electronics (a red button 310, keypad 320 and biometrics 330) that holds the gun cartridge or immobilization plate 375. In certain embodiments, electronics (a red button 310, keypad 320 and biometrics 330) may be electrically connected via a computer link or communications line 305 to a computer of communications system.

Figure 11:
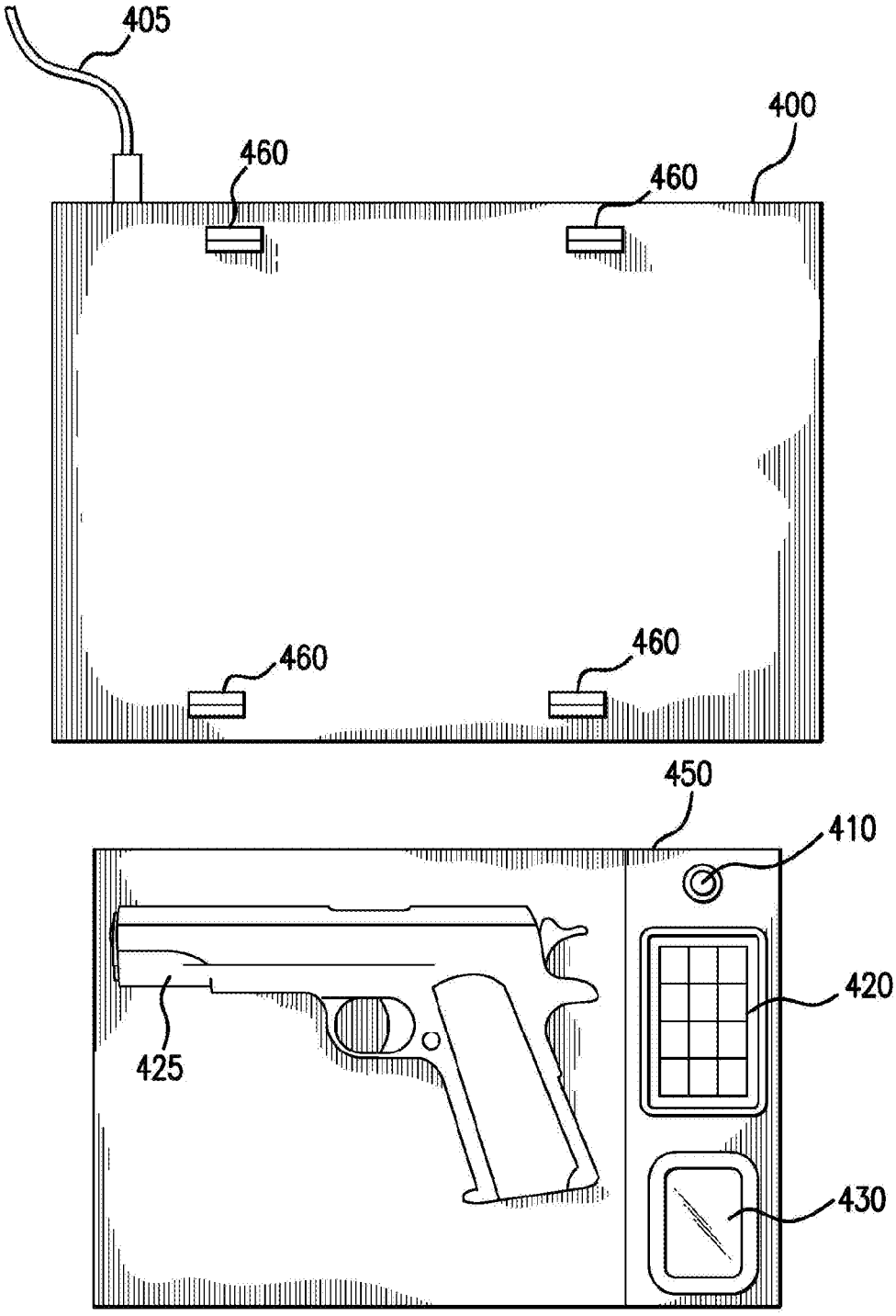
FIG. 11 is a schematic illustration of a further wall plate that secures a weapon mounted on an immobilization plate thereto.

FIG. 11 is yet another wall plate 400 with a snap locking mechanism 460 that allows a cartridge or immobilization plate 450 with electronics (red button 410, keypad 420 and biometrics 430) thereon to be mounted on the wall plate 400. In certain embodiment, gun 425 may be mounted to plate 450 by engaging a corresponding mechanism. In some embodiments, electronics (a red button 410, keypad 420 and biometrics 430) may be electrically connected via a computer link or communications line 405 to a computer of communications system.

Figure 12:
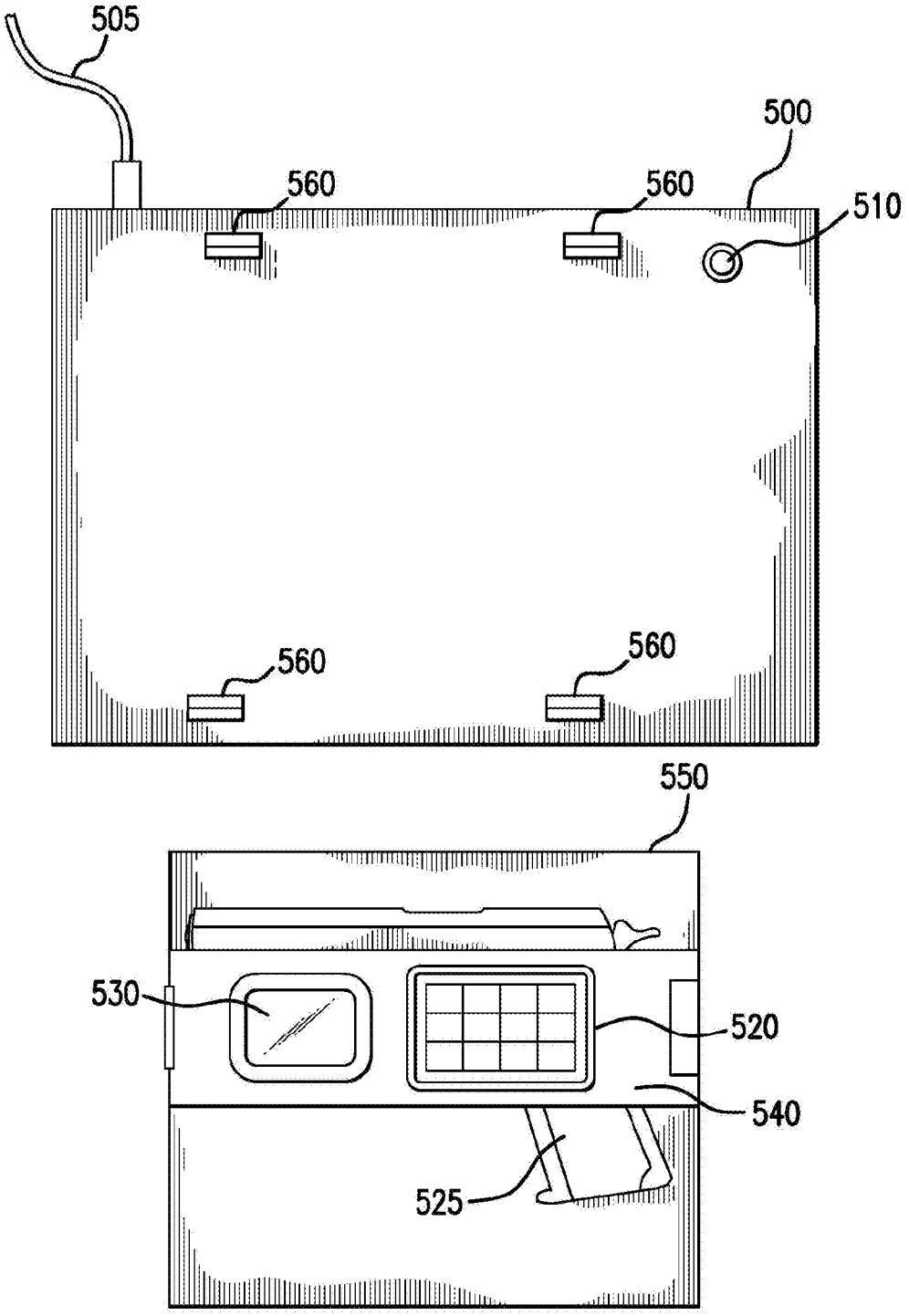
FIG. 12 is a schematic illustration of an alternative wall plate that secures a weapon mounted on an immobilization plate thereto.

FIG. 12 is another wall plate 500 similar to that of FIG. 11 and having a snap locking mechanism 560. Wall plate 500 has red button 510 but the gun 525 or gun cartridge or immobilization plate 550 includes keypad 520 and biometrics 530 disposed on a mounting plate 540 configured to envelope gun 525. These would be activated when the gun, cartridge or immobilization plate are removed from the wall plate. In some embodiments, keypad 520 and biometrics 530 may be electrically connected via a computer link or communications line 505 to a computer of communications system.

Another use of the invention would be that the cabinet or wall plate can send information regardless whether the situation is an emergency or not. A cabinet and mounting module could be used e.g. by plugging a guitar or instrument into it. The box would allow a user to communicate their work to the cloud for someone else to monitor or review. A website could be available for users such as a music teacher reviewing play of music or a composition. This box can be used to monitor construction from a supervisor and to link it back to a website or the cloud for the user to go back and retrieve at a later time. The box with inputs would be capable of triggering devices to do things from a remote location. The user could initiate a command from a phone, tablet, watch or other mechanism wherein the device is plugged into another box or module. The guitar or other input could be used as a code to access the box or to operate something at the remote location. For example, if someone had a storage building in California and wanted to open it remotely with the sound of a guitar cord played, the connections between the boxes communicating back and forth would allow it.

Additional features of the invention are provided by the box itself with regard to its size, shape, color and types of functions of work flow to provide safe access with alerts from the operation of mechanisms to access the internal compartment. The activation buttons can also be used to activate sirens, doors, keypads, other rooms or compartments, lights or other related functions or mechanisms.

As the box would not have any signals to transmit wired/wirelessly from any cameras or transmit signal taking from a mike, it would just send audible alerts through a speaker with flashing text on a LCD screen and have bright flashing lights on top of the box for viewing for the deaf. This box would have provisions for mounting all kinds of sensors. The compartment box would have an onboard speaker connected to an electronic circuit board that creates an audible alert when triggered and same with text. The compartment box would have a battery for use when power is out but would typically be hard wired for continuous power. The mechanisms can still work opening doors without having any power battery/electrical as well as no sirens or flashing text. The siren when having power can be loud enough to be heard nearby.

Yet another feature of the invention is a detection system which can be added to the previously disclosed firearm box. This detection system includes a detection device that is wirelessly connected to a detectable collar, ankle bracelet, chip that is worn on or by an unauthorized person. As that person comes into range of the detection device that is associated with the firearm box, an alert is triggered by the detection device. For example, if there are areas where the firearm box is located and this area is off limits to people such as felons, mentally ill, suspected terrorist or registered sex offender, the detection device will read the detectable collar, ankle bracelet, or chip and send an alert that signifies the presence of the unauthorized person. This system would be triggered when the unauthorized or restricted person is in proximity of the sensors of the detection device. If desired, sensors would be installed at the front door, in the yard, or in another area of interest such as by a school or government building. Although wireless sensors are preferred, the sensors can be hard wired instead depending upon the configuration and age of the building. As the system is triggered, alerts are sent to owners of the firearm box or of others who would need to know of the presence of such unauthorized person. For example, a mother of a child at a school could be notified at work that a felon, mentally ill person, suspected terrorist or registered sex offender is in proximity of the school as measured by the device that is present in the firearm box and that scans a perimeter which is the sensor area.

Additionally, a firearm security system and access lock can be provided on the weapon that is maintained in the firearm box.

This firearm security system would be similar to that described in Torii U.S. Pat. No. 5,598,151. This security system is provided for the containment of at least one firearm in the firearm box and it operates in conjunction with an alarm system adapted to generate a signal upon the emergency opening of the repository indicative access to and removal of the firearm contained therein. The alarm system generates a signal at a remote location that is indicative as to whether the weapon in the firearm box has been accessed and/or removed in an intended manner, such as by a criminal that overpowers the person that has authorized access to the firearm box or when the weapon is removed under emergency and/or duress conditions. The Torii patent also discloses arrangements of electronic components to carry out this monitoring of the movement of the weapon. When used in conjunction with the other features of the invention, it becomes easy to determine where the weapon is located so that backup or reinforcement personnel can be quickly deployed to the appropriate area to provide assistance or defense.

Embodiments of the present invention further disclose an electronic trigger lock for a firearm and a firearm frame having an electronic trigger lock. The electronic trigger lock is configured to disable the trigger of the firearm to prevent firing the weapon under certain conditions. The electronic trigger lock can be used with a stand-alone firearm in that respect. The electronic trigger may also be employed as part of a broader security system that enables monitoring, and selectively and remotely enabling or disabling one or more weapons having the electronic trigger lock under certain conditions. The use of the electronic trigger lock as described herein enhances gun safety and the security of the premises where the firearms are stored or used.

In some applications there is a need to provide access to a firearm such as a gun to provide protection in an emergency or a due to a sudden exigency or potential threat. There are various guns and gun related technology that have been developed over the years. Embodiments of the present invention provides for a device, system, or method that provides an additional level of protection when for example a firearm must be disabled due to the firearm being in the wrong hands or if circumstances creating the exigency has ended. Embodiments of the present invention incorporates a gun frame or lower that is for example produced as a single piece using steel or other material to include a receiving frame for electronics and/or mechanical elements that can be used to remotely lock the firearm when a signal is received at the firearm. The structure may include a circuit board, a battery, and mechanical arm (that can extend out) that are configured to disable the physical trigger of the firearm. The trigger may for example be adapted to have a section that can receive the arm to prevent the trigger from being pulled to fire the firearm.

In accordance with the principles of the invention, a gun frame or lower can be manufactured as a single piece or substantially one solid piece that includes a frame or support that is adapted to receive the mechanical and/or electrical components configured to remotely control the trigger or freedom to operate a handgun or firearm. In the manufacturing process, the mold for producing the gun frame, using steel or other materials (e.g., by way of pouring molten material into the mold), includes an additional area that is adapted to support or receive the equipment that provides or enables the control features. As shown in the figures, in some embodiments, it can be formed in the area adjacent to the trigger under the barrel of the weapon. The mechanical or electrical equipment can be mounted or housed in that area created by the manufacturing process. It is possible that the features and equipment can be located in other areas of the weapon (handgun) such as on the handle or under the handle. As described also below, a mechanical member such as the plunger can be positioned inside or extend out of this support area. In some embodiment, the mechanical and/or electrical equipment can be adapted to be implemented and/or to be integrated into a shape and structure of weapon without the need create or include a specialized member or physical support that is visibly perceived from viewing the weapon. For example, electrical circuits can be positioned in the barrel or under barrel that control a mechanical switch that disconnects the trigger or inserts a physical block (or electrical switch) in the firing mechanism of the weapon that blocks trigger rotation or firing. The circuitry on the weapon is preferably configured to be securely controlled using for example an address or unique address for the specific weapon. The address is configured to permit remote control for the blocking operation of that specific weapon. The improved weapon can be incorporated into a wireless network in a campus or enterprise or can be incorporated into a wide geographic area. For example, it can be integrated by way of a cellular base station and cellular communication (or other wireless system) to cooperatively control and communicate with handguns in a state, country, or across jurisdictions. For example, security officers or police officers may be provided with handguns that can be remotely controlled to block the ability to fire the weapon (e.g., block the trigger from moving). A blocking member such as a plunger can be configured to be connected to an actuator and apply force to the blocking member that positions the member in a physical location that mechanically and/or electronically places the weapon in a mode or state in which moving the trigger or firing the mechanism is blocked from operation. The onboard circuitry includes circuit lines that connect to the actuator and circuitry that is configured to receive remote commands over the air to trigger the (safe) mode or state. The physical structure of the weapon can be adapted to include a hole (an access way in the structure around the trigger such as cavity in the trigger guard at the top near the junction with the under barrel) that permits the blocking member to extend into the area of the trigger to physically block a member of the gun that requires movement to fire the gun.

Figure 13:
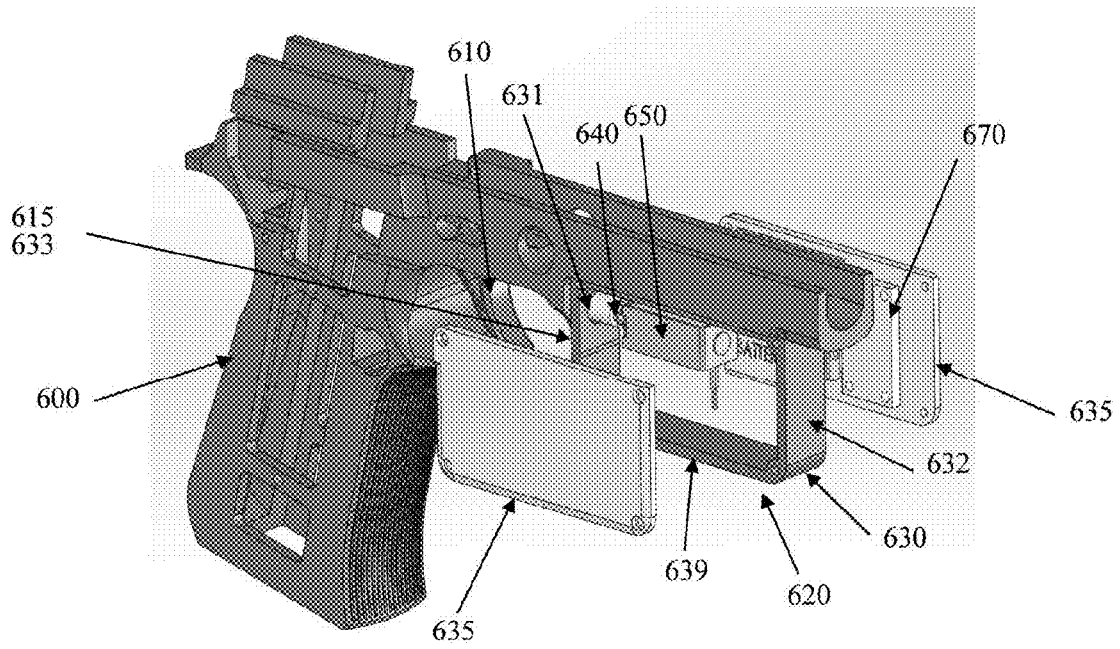
FIG. 13 illustrates a perspective view of a firearm frame having an electronic trigger lock according to an embodiment of the present invention.
Figure 15A:
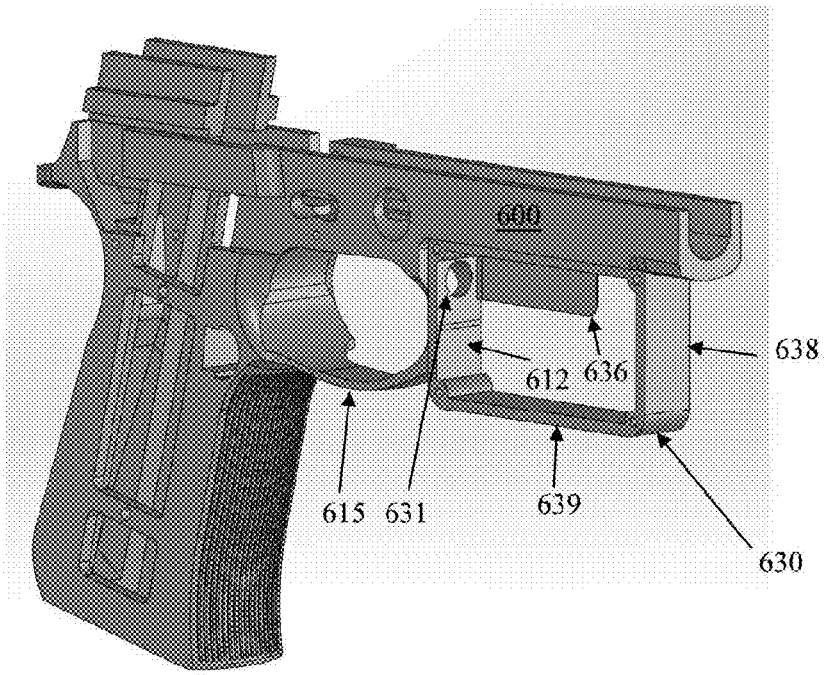
FIGS. 15A and 15B illustrates perspective views of a firearm frame configured to house an electronic trigger lock according to an embodiment of the present invention.
Figure 15B:
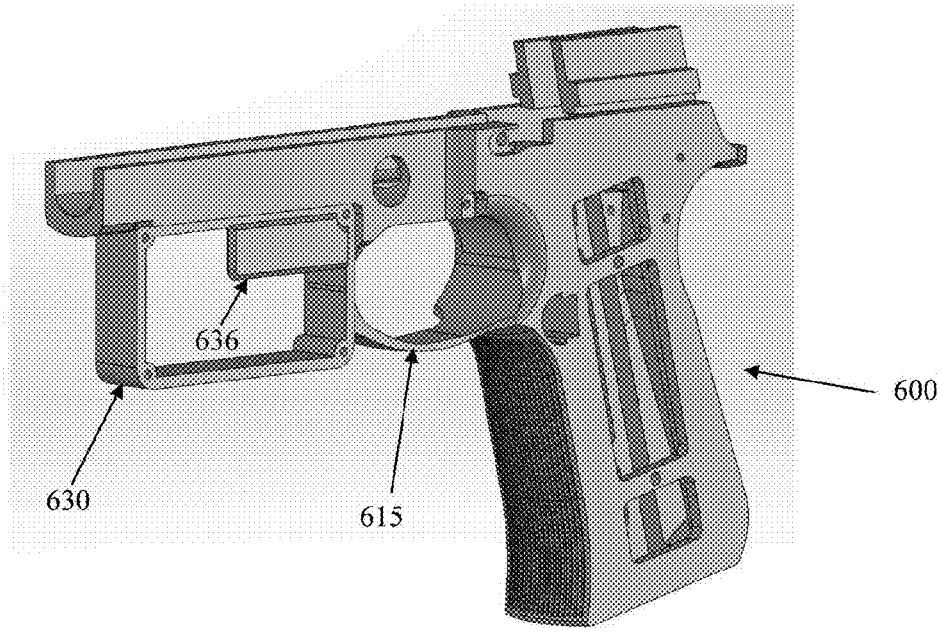

FIG. 13 illustrates a perspective view of firearm frame 600 having an electronic trigger lock 620 according to an embodiment of the present invention. The firearm frame or gun lower or gun receiver 600 is the foundational structure of a firearm to which other components of the firearm are mounted, such as the barrel or the trigger mechanism including trigger 610, and serves as a backbone for a fully assembled firearm. The electronic trigger lock 620 is located below the barrel and adjacent to the trigger guard 615. The electronic trigger lock 620 is includes a housing 630. The housing 630 is configured to encase the components of the electronic trigger lock 620. In some embodiments, the housing 630 or part of the housing 630 of the electronic trigger lock 620 is an integral part of the gun frame 600. FIGS. 15A and 15B illustrates the firearm frame 600 comprising a portion of an electronic trigger lock housing 630 that is integrally formed with the frame. In such embodiments, the housing 630 is therefore made of the same material as the firearm frame, e.g., a metal, alloy, polymer, or other material suitable for a gun frame. In other embodiments, the housing 630 is separate from the gun frame 600 and mounted thereto using a variety of fastening means such as screws or welding. In some embodiments, the electronic trigger lock 620 is permanently attached to the gun frame 600, whereas in other embodiments, the trigger lock 620 may be configured to be mounted and removed by the user.

Referring back to FIG. 13, the housing 630 comprises a front wall 632, a rear wall 633, top wall 638, bottom wall 639, and sidewalls 635. The rear wall abuts the trigger guard 615, and in some embodiments, may constitute a part of the trigger guard 615. Further, the rear wall 633 features an opening or aperture 631 that provides access from the housing 630 to the trigger 610. In some embodiments, the front, rear, top, and bottom walls are integrally formed as a single unit and further, may be integrally formed with the gun frame 600. In particular, the part of the gun frame 600 that support the barrel may constitute the top wall 638 of the housing of the housing 630. The sidewalls 635 of the housing 630 may be removable, and may be fastened to the rest of the housing 630, using a variety of fastening means such as screws. The sidewalls 635 provide access the components of the electronic trigger lock 620 inside the housing 630. Further, some components of the trigger lock (e.g., a battery) may be mounted onto the one or both sidewalls 635, in some embodiments.

Figure 14:
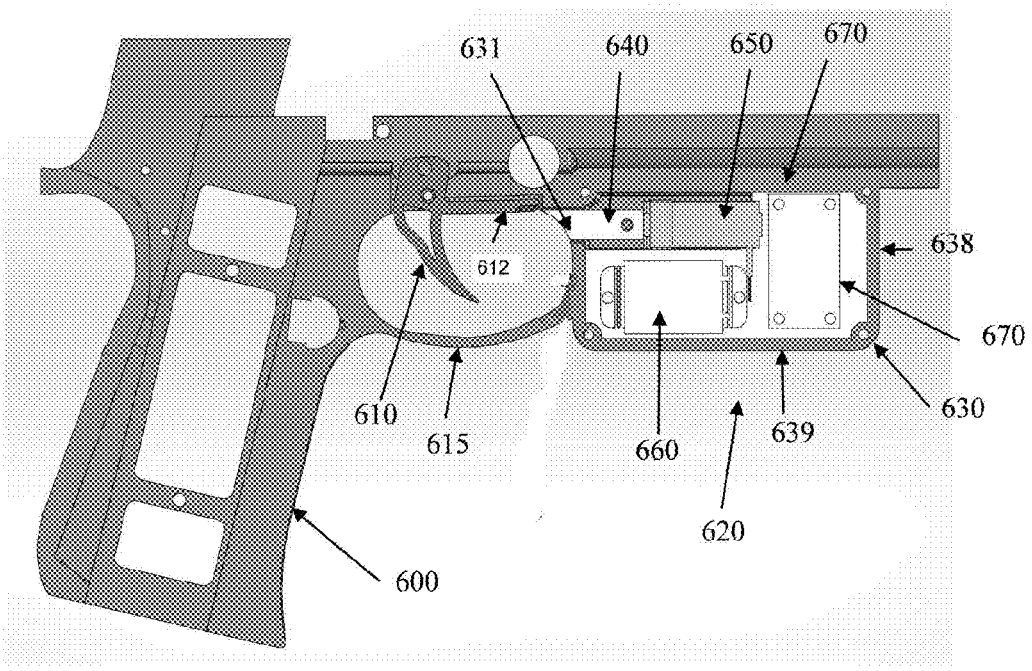
FIG. 14 illustrates a side view of a firearm frame having an electronic trigger lock, according to an embodiment of the present invention.

FIG. 14 illustrates a side view of a firearm frame 600 having an electronic trigger lock 620, according to an embodiment of the present invention. The electronic trigger lock further includes a plunger or pin 640, an actuator 650, a battery 660, and electronics 670. The plunger 640 is positioned adjacent to aperture 631 of the front wall 632, and is mechanically connected to the actuator 650. The actuator 650 is configured to extend the plunger 640 from the housing 630 into trigger guard 615 and retract the plunger back into the housing 630. The plunger 640 is an elongated member oriented along the length of the firearm frame 600 and serves as a blocking member 640 for the trigger 610. That is, the plunger serves to block the trigger 610 from firing the weapon when extended by the actuator 650. In particular, the plunger extends below trigger member 612 and blocks the trigger member 612 from pivoting along with the trigger 610 when it is pressed, thus immobilizing the trigger 610 and preventing the firing of the weapon.

The plunger may be made of any other material sufficiently strong to resist the downward pressure of the trigger member 612 when the trigger is pressed. In the embodiment illustrated, the plunger 640 is a metal rod and actuator 650 is a solenoid configured to extend and retract the plunger 640 when energized and de-energized. However, other configurations of plunger and actuators are possible. For example, the actuator 650 may be a motor (e.g., a stepper motor, micro motor, etc.) configured to drive plunger or pin 640 in and out of the trigger guard. In such embodiments, the motor 650 may be mechanically connected to the plunger 640 via an intermediate mechanical assembly such as a linkage, or a gear system, for example. The trigger member 612 is adapted to be integral with trigger 610 by way being of a single piece or having attached together. The configuration of trigger member 612 and trigger 610 is that when the trigger 610 is pulled the trigger member 612 is in a fixed and rigid relation with the trigger 610 (e.g., about the same axis) and as a result, the trigger member 612 rotates down (rotates clockwise) when the trigger 610 is pulled. The adaptation is structured such that member 612 is not normally blocked and is freely available for rotation such as when the firearm is being accessed. The default position is not blocked. When the blocking member is actuated the plunger actuates and by way of the plunger creates an obstacle in front of the trigger member 612. The obstacle blocks the ability of the member 612 to allow the structure to pivot or rotate and because of the relationship with the trigger 610 prevents the trigger from rotating to a point in which the gun is fired.

The actuator and plunger assembly are mounted on a vertical flange 636 that extends down from the top wall of the housing and is oriented parallel to a side wall. In some embodiments, the flange 636 is integrally formed with the frame 600. Mounting the actuator assembly on a structure that is part of the frame (as opposed to the sidewalls 635 of the housing 630) reinforces the structural integrity of the actuator assembly and the trigger lock 620 against forces exerted by the trigger 610 against the plunger 640 and actuator 650 when the lock is activated and an attempt is made to press the trigger 610.

The electronic trigger lock 620 further comprises electronics 670. The electronics 670 are configured to control the operation of the actuator, which includes commands to extend and retract the plunger from the trigger guard. The electronics 670 further include a wireless receiver and or transceiver configured to communicate with wireless devices. This enables the electronic trigger locks to receive wireless commands to lock and unlock the trigger, in some embodiments. The wireless receiver or transceiver may employ a variety of wireless communication protocols such as WiFi, Bluetooth, RFID, etc. In some embodiments, the electronics 670 are configured to store an address or a unique address for the firearm (for example, in a memory included in the electronics 670). The address is configured to permit remote control for the blocking operation of that specific weapon.

The electronic trigger lock 620 further includes a battery 660. The battery 660 is configured to provide power to the various components of the electronic trigger lock such as the actuator 650 and electronics 670. As such, the battery may be a primary battery (non-rechargeable) or a rechargeable battery, such as a lithium-ion battery or similar. In some embodiments, the battery 660 is installed on an inner surface of removable sidewall 635 to facilitate replacement. The various electrical components of the electrical trigger lock, which include the actuator 650, battery 660, and electronics 670, are interconnected with electrical wires or cables, or other suitable electrical conductors.

Figure 16:
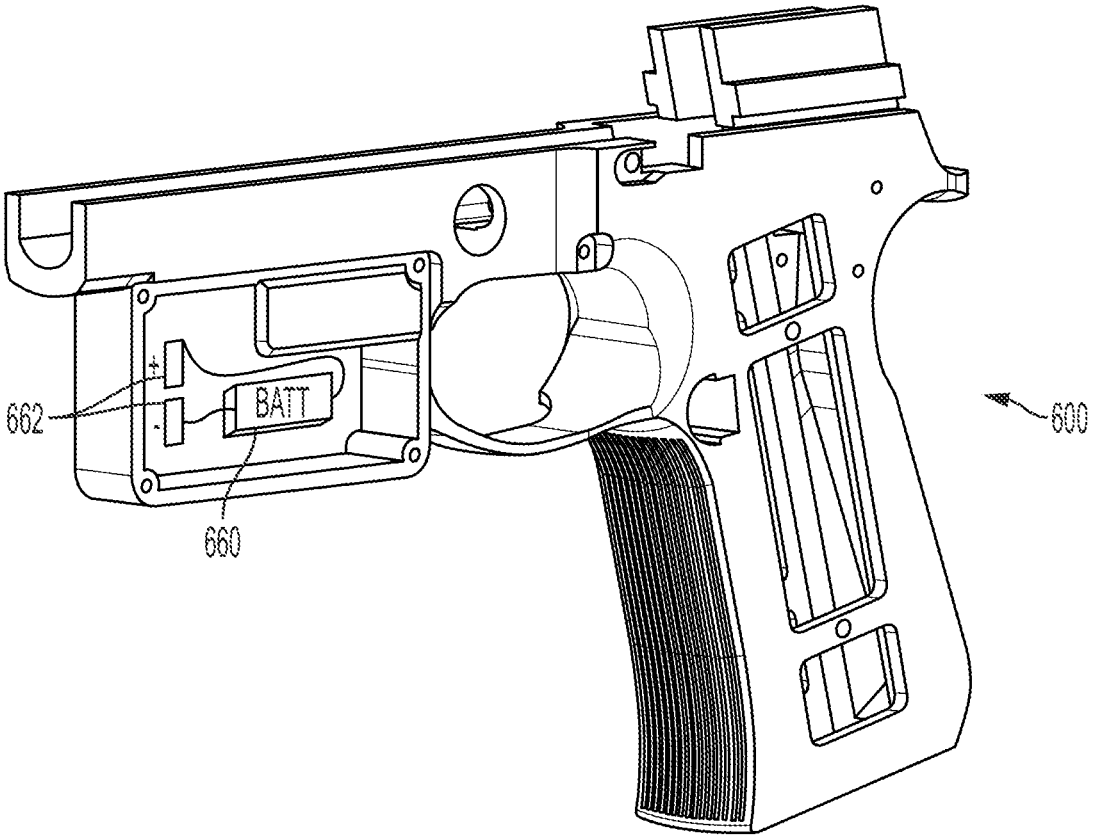
FIG. 16 illustrates a perspective view of a firearm frame having an electronic trigger lock and featuring charging contacts, according to an embodiment of the present invention.

In some embodiment where the electronic trigger lock 620 includes a rechargeable battery 660, metallic charging tabs or contacts 662 may be provided on the electronic trigger lock 620 or firearm frame 600 for charging the battery 660. FIG. 16 illustrates a perspective view of a firearm frame 600 having an electronic trigger lock 620 and featuring charging contacts 662, according to an embodiment of the present invention. The contacts 662 may be disposed on an outer surface of the trigger lock 620 or frame 600 and each contact 662 may be electrically connected to a corresponding terminal on the battery 660 via an electrical wire or other electrical conductor. The contacts 662 enable the battery 660 of the electronic trigger lock 620 to be charged by an external battery charger whose terminal is configured to connect to the contacts 662 of the trigger lock.

In some embodiments, the external battery charger may be located in a weapon cabinet where the gun featuring the gun frame 600 is stored. In particular, the contacts of the battery charger may be positioned in the cabinet such that when the gun frame 600 is installed in the cabinet, the contacts 662 of the gun frame and the contacts of the battery charger are connected and electrical power flows from the battery charger to the battery 660 via both sets of connected contacts to charge the battery. The electronic trigger lock 620 may thus be charged merely by being installed it in the cabinet configured for charging the trigger lock, in some embodiments. Other charging apparatuses or receiving structures having a battery charger are contemplated, such as a standalone battery charger or a docking station configured to receive the gun frame 600, all comprising terminals having contacts configured to match the contacts 662 of the electric trigger lock 620 to charge the battery 660 therein.

The electronic trigger lock 620 of the present invention may be built as a normally-off device. That is, when the actuator 650 is off, the locking member 640 is retracted and the trigger 610 is enabled. Thus, in embodiments where the actuator 650 is a solenoid, the plunger 640 is retracted from the trigger guard 615 when the solenoid is de-energized. Conversely, when the solenoid 640 is energized the assembly locks the trigger 610. This configuration enables the weapon to be passively enabled and actively disabled, thus permitting the use of the weapon unless the need arises to disable it (such as when accessed by an unauthorized person).

If desired, in some application, the electronics and mechanical structures can be configured unlock (e.g., if default position is locked) or configured to lock and unlock in response to a signal received by the circuitry.

Figure 17:
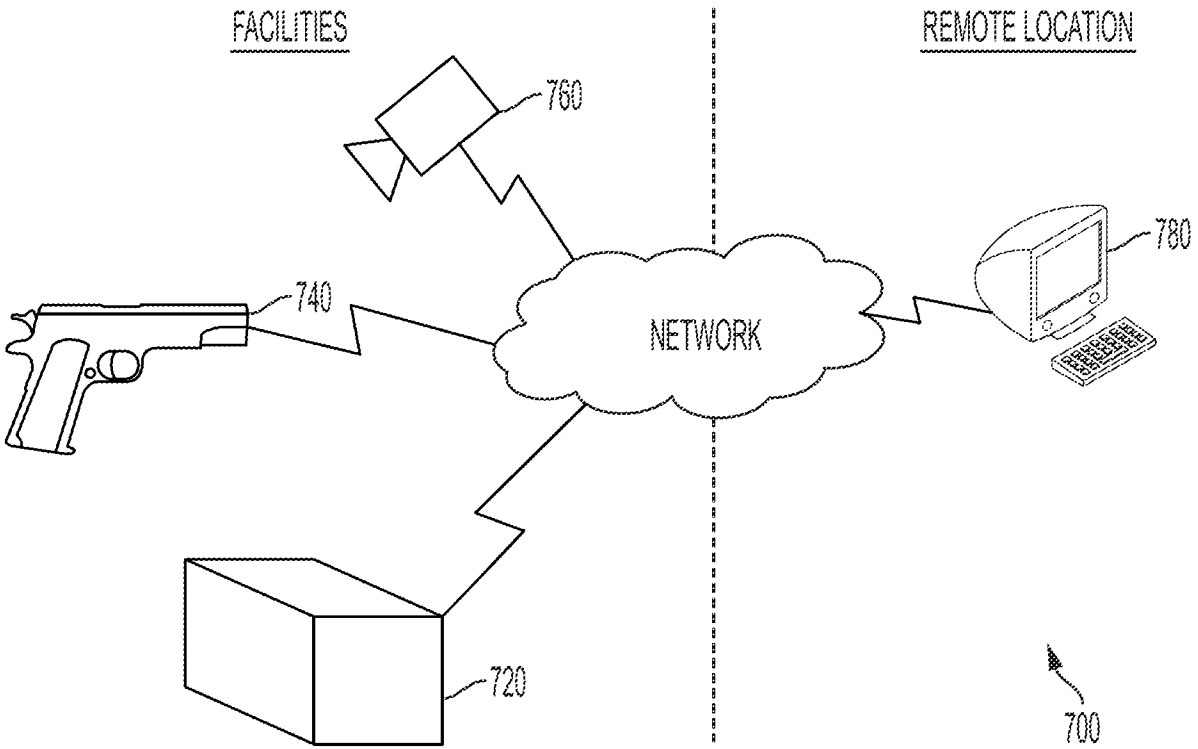
FIG. 17 illustrates a system diagram of an exemplary security system, according to an embodiment of the present invention.

FIG. 17 illustrates a system diagram for an exemplary security system 700 comprising the electronic trigger lock 620, according to an embodiment of the present invention. The security system 700 enables the safe storage, monitoring, enabling and disarming of the weapon from a remote location. The security system 700 comprises a cabinet 720, the weapon 740 having an electronic trigger lock, monitoring equipment 760, and a monitoring station 780. The cabinet 720 is configured to receive and safely store weapon 740. The cabinet 720 may have a variety of shapes and operate in a variety of manners. In some embodiments, the cabinet 720 is substantially similar to the lockable firearm cabinet 100, previously described. The cabinet 720 may thus comprise a receptacle for receiving the weapon 740, a locking or self-locking mechanism for securing the weapon 740, and other features of lockable firearm cabinet 100. The cabinet 720 may further comprise a battery charger and corresponding terminals, for charging the battery in electronic trigger lock of weapon 740, as described above in reference to the gun frame 600 and trigger lock 620. In some embodiments, the cabinet 720 further includes electronics configured for wireless communication with the monitoring station.

The weapon 740 features the frame 600 having the electronic trigger lock 620. Accordingly, the weapon 740 can be disabled or enabled remotely via a wireless signal received by the electronics 670, which comprise a wireless receiver or transceiver, as previously described. This enables firearm protection to be provided to the facility on a selective basis. For example, the weapon 740 can be remotely enabled during active situations and disabled otherwise. In some embodiments, the weapon 740 may have a unique address that enables the weapon to receive commands specific to the weapon, for example as described in relation to the electronic trigger lock 620 comprising the electronics 670 having a memory configured to store a unique address for the weapon. The security system 700 may comprise more than one cabinet 720 and weapons 740, which may all be located in the same facility to be protected, or in multiple facilities. Each of the weapon 740 may be remotely and selectively enabled or disabled with a wireless signal. In some embodiments, the weapon 740 may have a structure (e.g., mounting structure 210) configured to interact with a corresponding structure in the cabinet 100 to self-lock, as previously described in reference to the cabinet 100 and shown in FIG. 3-8C.

Monitoring equipment 760 may be located in the same room or facility as the cabinet 720 and weapon 740. The monitoring equipment serves to record and transmit the status of the facilities housing the cabinet and weapon to the remote monitoring station. Typically, the motoring equipment 760 is a camera configured to record and transmit video of a room. The monitoring equipment 760 may also comprise a microphone, IR camera, proximity sensors, or other electronic devices and sensors configured to detect disturbance in the facility and/or provide recording thereof to the remote monitoring station 780. Further, the monitoring equipment may include the detection devices associated with the firearm cabinet or firearm box, as previously described. These could be used on conjunction with detectable collars, ankle bracelets, or chips associated with persons whose access to the firearm it is desired to control, in some embodiments. For example, monitoring equipment sensors 760 may be installed at the entry and exit points of the premises containing the firearm cabinet to detect access to the premises. The monitoring equipment 760 may transmit the sensed or recorded information to the monitoring station over a network via a direct connection to the monitoring station. For example, the monitoring equipment 760 comprising a camera and monitoring station 780 may form or be part of a close circuit television system.

The monitoring station 780 is typically located in a location remote from the cabinet 720 and weapon 740. The monitoring station 780 may be located in a different room from the cabinet and weapon, or in a different facility altogether. The monitoring station 780 may comprise a video monitor, audio speakers, a computer monitor, a computer system, a control panel, or any combination of the above. The monitoring station 780 is configured to receive information about or recordings of the facilities housing the cabinet 720 transmitted by the monitoring equipment 760. The monitoring station 780 is further configured to generate signals for enabling and disabling the weapon 740 for wireless transmission to the weapon. The security system 700 as described enables the safe monitoring and selective firearm protection of the facilities covered by the system.

Weapon 740 includes circuitry such a circuit board, semiconductor chip(s), contact lines, resistors, transistor, capacitors etc. The circuitry is configured to include a one or more circuits (such semiconductor chips) configured to implement wireless communications, implement a processor (with memory) to control the operation of the device, power circuitry for receiving power, lights or other light indicators and/or other circuitry.

Figure 18:
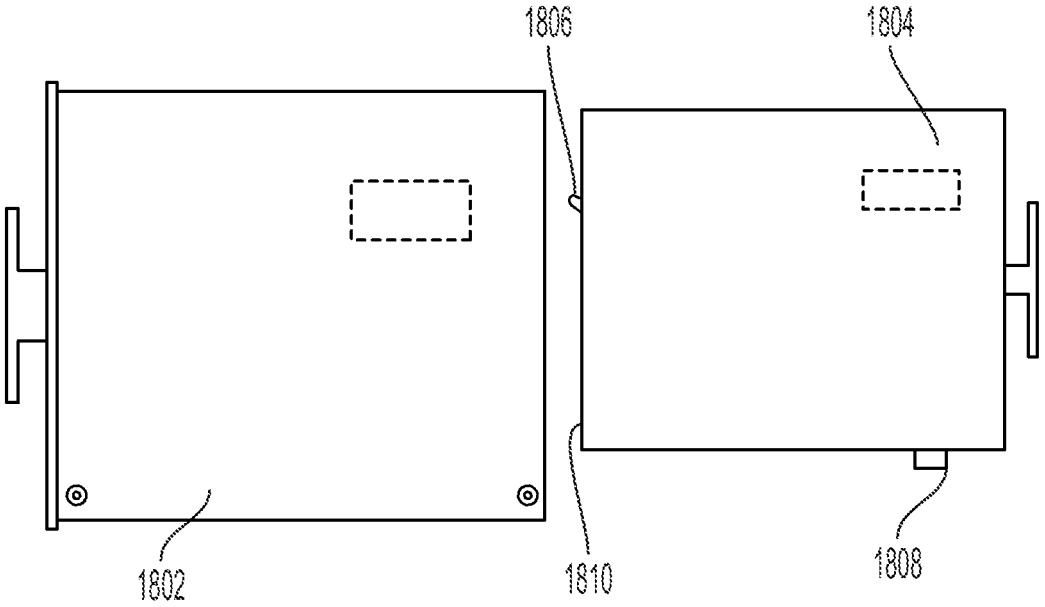
FIG. 18 illustrates a side view line diagram of a receptacle and cartridge according to an embodiment of the present invention.
Figure 19:
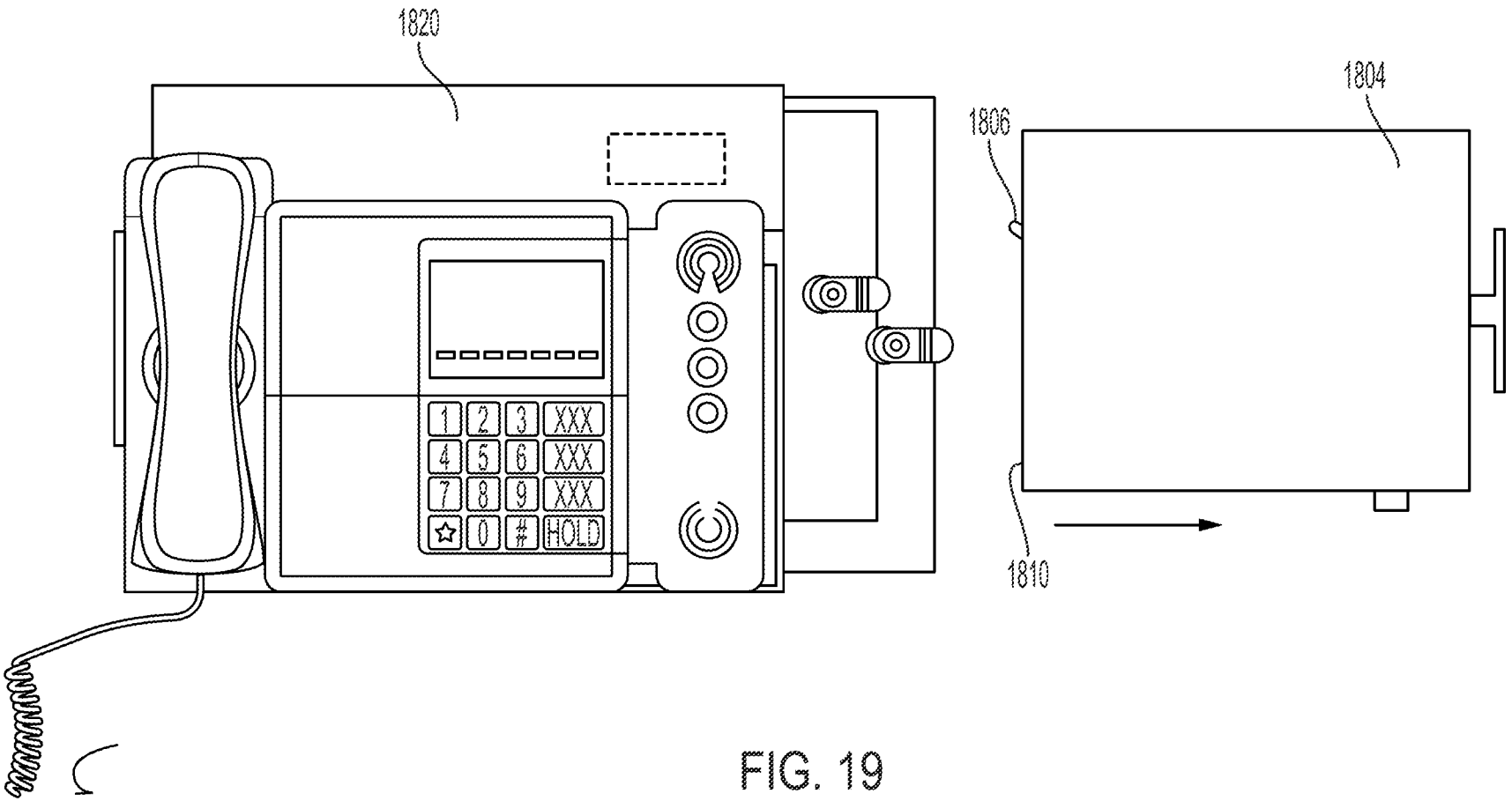
FIG. 19 illustrates a side view line diagram of a cartridge being removed from a cabinet according to an embodiment of the present invention.
Figure 20:
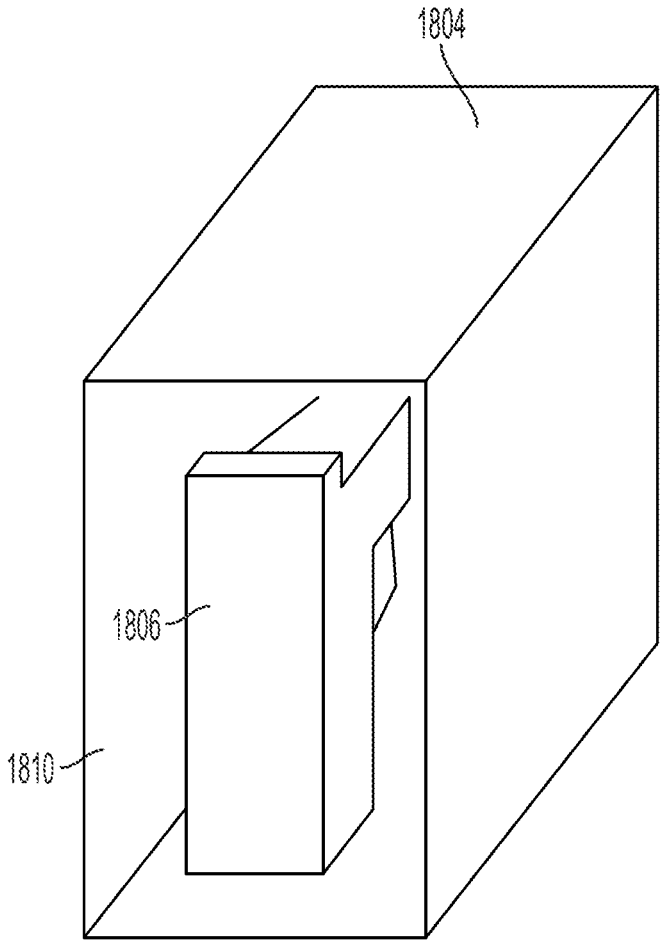
FIG. 20 illustrates a simplified perspective view of a weapon in a cartridge according to an embodiment of the present invention.

FIG. 18-20 illustrate or clarify aspects of embodiments of the present invention such as aspects described above. For example, in FIGS. 1A-6, the figures illustrate embodiments in which a weapon is received by a receptacle using an attachment on the handle of the weapon. FIGS. 18-20 provide supplemental illustrations of one or more embodiments in which a weapon is received by a weapon cartridge and the weapon cartridge is received by the receptacle using an attachment on the bottom of the weapon cartridge. For clarification, an additional structure is included that locks into the receptable (such as for use in carrying the receptacle to the location of the cabinet) and the weapon is inserted into the additional structure. The additional structure is adapted to have an envelope to receive the weapon and have an opening on one end to allow the user to freely pull the weapon from the envelope (without locks, interference, or impediments). The additional structure, the weapon cartridge, is adapted to work with the locking mechanism as described herein. The terms weapon cartridge, receptable, cabinet, mounting structure, and locking mechanism are discussed above and are being used in connection with FIGS. 18-20 for the same purposes but to the extent the figures and description add more subject matter or information it should be understood that such variations, embodiments, or alternatives are contemplated.

FIG. 18, using additional reference numbers for illustration purposes, illustrates receptable 1802, weapon cartridge 1804, weapon 1806 (inside the weapon cartridge 1804), and mounting structure 1808. Weapon 1806 is inserted into cartridge 1804 and cartridge 1804 may contain a foam insert or potentially other structures (or combinations) to receive and/or hold the weapon. Cartridge 1804, for example, has an opening at the one end 1810 for allowing the insertion and removal of the weapon, while the surrounding structure involves solid walls that prevent access to the weapon from those sides. Mounting structure 1808 is included on the bottom of cartridge 1808 and is adapted to function the same as in the above descriptions where it is received by the receptacle 1802 (e.g., using slot 180). The cartridge 1804 is inserted into the receptacle 1802 (e.g., visually in connection with the figure by sliding the cartridge 1804 laterally into the receptacle 1802).

FIG. 19 illustrates the cartridge 1804 being removed from cabinet 1820. The cartridge 1804 includes a handle that the user can grasp to move the cartridge 1820 out from the cabinet (and respectively the receptacle). In this example, there are two key-lock doors (shown to have been opened) to allow for the user grasp the handle and pull the cartridge 1804 out.

FIG. 20 provides a simplified line drawing of a top perspective view of the cartridge 1804 with a weapon 1806 inside and opening 1810.

Figure 21:
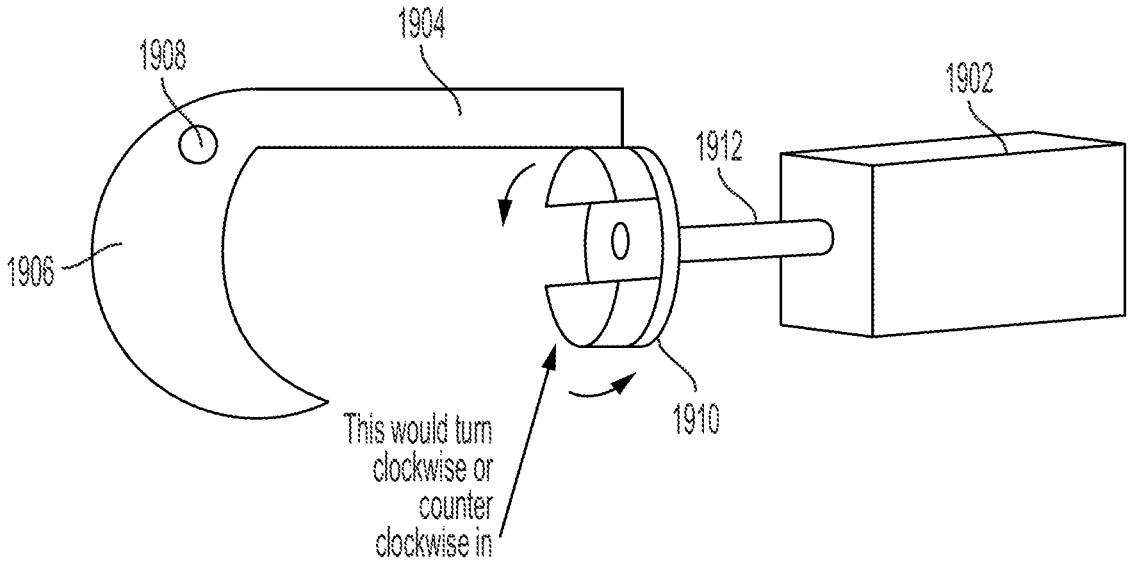
FIG. 21 illustrates a feature for physically blocking the trigger from pivoting according to an embodiment of the present invention.

FIG. 21 illustrates an embodiment of the blocking member (and arrangement) that comprises a rotating member that includes a channel disposed between protrusions (raised levels). Actuator 1902 can be configured to connect to a blocking member 1910. This is a similar arrangement to the structure described in FIGS. 13-16. In FIG. 1902, the blocking member rotates to block the trigger member 1904

(and consequently trigger 1906) from moving to a position that fires the firearm. Trigger member 1904 and trigger 1906 rotates around axis 1908. Blocking or rotating member 1910 comprises a physical structure in which a straight channel is formed in member 1910 by way of protrusions or raised levels on each side of channel. The walls of the protrusions or raised levels form the sidewalls of the channel. Member 1910 is in a round shape and is attached to actuator 1902 using arm 1912. Actuator 1902 is configured to turn member 1910 to a position that aligns the channel with trigger member 1904 to allow trigger member 1904 to rotate through the channel and consequently allow the trigger 1906 to be pulled to the point of firing the weapon. In another position, the member 1910 is in a position in which the protrusions or raised levels are in a physical relationship with the trigger member 1904 such that the path of the trigger member 1904 is blocked preventing the trigger to be moved to a position to fire the weapon. The protrusions or raised levels are on the perimeter of the member 1910. As mentioned above, the default position is to have the channel aligned with the trigger such that the weapon is ready and the member 1910 is rotated to be in a blocking position when the actuator is triggered (such as when a situation is detected, for example, the weapon has been taken by an unauthorized individual).

As is evident, the weapon can be a weapon that includes the integrated structure and electronics described such as in connection with FIG. 13-16 or it could be other weapons such as an off-the shelf weapon, a handgun. FIGS. 18 and 19 illustrate dashed line boxes that represent integrated wiring, circuits, or circuitry in cartridge 1804, receptacle 1802, and/or cabinet 1820. These features can be included to support the function and operation of embodiments of the present invention illustratively described in FIGS. 13-16. For example, the dashed box on cartridge 1803 represents electrical contacts that are adapted to connect or touch electrical contacts on an inserted handgun to supply electricity such as to charge or recharge a battery located in the gun lower or other electronics. Electronics (such as contacts) on the cartridge 1804 may connect to electronics on the receptacle and/or cabinet, for example, to connect to a power source and/or other purposes. Wireless connections or power supply is also contemplated.

If desired, elements of the implementation can be incorporated into other parts or locations of the firearm.

It is understood from the above description that the functionality and features of the systems, devices, or methods of embodiments of the present invention include generating and sending signals to accomplish the actions.

It should be understood that variations, clarifications, or modifications are contemplated. Applications of the technology to other fields are also contemplated.

Exemplary systems, devices, and methods are described for illustrative purposes. Further, since numerous modifications and changes will readily be apparent to those having ordinary skill in the art, it is not desired to limit the invention to the exact constructions as demonstrated in this disclosure. Accordingly, all suitable modifications and equivalents may fall within the scope of the invention.

It should be understood that claims that include fewer limitations, broader claims, such as claims that do not require a certain feature or process step in the appended claim or in the specification, clarifications to the claim elements, different combinations, alternative implementations based on the specification, and different uses are also contemplated by the embodiments of the present invention.

It should be understood that combinations of described features or steps are contemplated even if they are not directly described together or not in the same context.

The terms or words that are used herein are directed to those of ordinary skill in the art in this field of technology and the meaning of those terms or words will be understood from terminology used in that field or can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

The words "may" and "can" are used in the present description to indicate that this is one embodiment but the description should not be understood to be the only embodiment.

It is intended that the specification and examples be considered as exemplary only, with a true scope being indicated by the claims and their equivalents.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A firearm lower to which other components of a firearm are mounted, comprising:

a trigger adapted to have a surface adapted to receive a finger of a user to pull the trigger and the trigger extends into a trigger guard of the firearm lower;

a trigger member adapted to integrally protrude from the trigger and have a fixed relationship to the trigger, wherein the trigger member includes a blocking side that is positioned above the surface adapted to receive the finger of the user, the trigger member and blocking side are adapted to rotate about an axis from a first position to a second position in response to the trigger being pulled to fire the firearm;

an electronic trigger lock housing integrally formed with the firearm lower, wherein the electronic trigger lock housing comprising an electromechanical actuator, a power source, and electronic circuitry; and a blocking member that is in an operable relationship with the actuator, disposed adjacent to the trigger guard of the firearm lower, and cooperatively arranged in relation to the trigger member to extend or rotate, in response to the actuator, to retain the trigger member in the first position by extending or rotating in front of the blocking side through an aperture on the trigger guard and by way of connection to the trigger, disable the trigger from firing the firearm, the aperture is positioned on a trigger guard surface that opposes the surface of the trigger adapted to receive the finger of the user and configured to be adjacent to a barrel mounted to the firearm lower, the electromechanical actuator is configured to actuate the blocking member, the power source is configured to power the actuator, and the electronic circuitry comprises a receiver that receives remote electrical signals that control the actuator.

2. The firearm lower of claim 1, wherein the electromechanical actuator is a solenoid configured to extend the blocking member into the trigger guard when energized and retract the blocking member from the trigger guard when de-energized.

3. The firearm lower of claim 1, wherein the blocking member is a plunger or a pin.

4. The firearm lower of claim 1, wherein the receiver comprise a wireless receiver configured to receive commands to lock or unlock the trigger.

5. The firearm lower of claim 1, wherein the electromechanical actuator is mounted on a portion of the housing that is integrally formed with the firearm lower to strengthen the electromechanical actuator and the blocking member against pressure from the trigger.

6. The firearm lower of claim 1, wherein the power source is a rechargeable battery and wherein the firearm frame further comprises contacts disposed on an outer surface of the frame, each contact being electrically connected to a terminal of the battery and the contacts being configured to receive power from an external battery charger to charge the battery.

7. The firearm lower of claim 1 wherein the blocking member comprises a block that has a channel that is in a relation with a trigger member that when the block is rotated in an aligned position the trigger member can travel through the channel.

8. The firearm lower of claim 1 wherein the trigger member and trigger are a single piece.

9. The firearm lower of claim 1 wherein the circuitry is configured to maintain the blocking member in a position that does not block, as a default position, until a remote signal instructs the firearm to be locked.

10. The firearm lower of claim 1, wherein the trigger member is aligned with the axis at the first position and the trigger is positioned at an angle relative to the trigger member and the axis, the trigger and trigger member rotating with one another about the axis as the trigger rotates from the first to the second position.

11. The firearm lower of claim 1, wherein the trigger member is configured as a lever protruding from the trigger.

* * * * *